US007502038B2

(12) United States Patent
Yasuda et al.

(10) Patent No.: US 7,502,038 B2
(45) Date of Patent: Mar. 10, 2009

(54) DISPLAY CHARACTERISTICS CALIBRATION METHOD, DISPLAY CHARACTERISTICS CALIBRATION APPARATUS, AND COMPUTER PROGRAM

(75) Inventors: Tetsuya Yasuda, Hakusan (JP); Naoaki Hirata, Hakusan (JP)

(73) Assignee: Eizo Nanao Corporation, Hakusan-Shi (JP)

( * ) Notice: Subject to any disclaimer, the term of this patent is extended or adjusted under 35 U.S.C. 154(b) by 497 days.

(21) Appl. No.: 10/576,587

(22) PCT Filed: Oct. 20, 2004

(86) PCT No.: PCT/JP2004/015502

§ 371 (c)(1),
(2), (4) Date: Apr. 20, 2006

(87) PCT Pub. No.: WO2005/041165

PCT Pub. Date: May 6, 2005

(65) Prior Publication Data

US 2007/0146266 A1 Jun. 28, 2007

(30) Foreign Application Priority Data

Oct. 23, 2003 (JP) ..... 2003-363719

(51) Int. Cl.
*G09G 5/10* (2006.01)

(52) U.S. Cl. ..... 345/690; 345/204

(58) Field of Classification Search ..... 345/600, 345/601, 204, 690
See application file for complete search history.

(56) References Cited

U.S. PATENT DOCUMENTS

| | | | | |
|---|---|---|---|---|
| 6,388,648 | B1 * | 5/2002 | Clifton et al. | 345/88 |
| 6,453,067 | B1 * | 9/2002 | Morgan et al. | 382/162 |
| 2003/0025688 | A1 | 2/2003 | Cottone et al. | |
| 2003/0048264 | A1 | 3/2003 | Cottone et al. | |
| 2005/0044371 | A1 * | 2/2005 | Braudaway et al. | 713/176 |

FOREIGN PATENT DOCUMENTS

| | | | |
|---|---|---|---|
| JP | 61-267795 | A | 11/1986 |
| JP | 5-127620 | A | 5/1993 |
| JP | 9-288468 | A | 11/1997 |
| JP | 2001-119717 | A | 4/2001 |
| JP | 2002-99238 | A | 4/2002 |
| JP | 2003-150099 | A | 5/2003 |
| JP | 2003-288056 | A | 10/2003 |
| JP | 2004-96698 | A | 3/2004 |

* cited by examiner

*Primary Examiner*—Ricardo L Osorio
(74) *Attorney, Agent, or Firm*—Birch, Stewart, Kolasch & Birch, LLP

(57) ABSTRACT

A liquid crystal display monitor comprises an LCD panel, a conversion section, an LUT, a monitor communication section, a light source control section, and a light source. The conversion section comprises an LUT. The LUT comprises, for example, an LUT for red, an LUT for green, and an LUT for blue corresponding to the three primary colors of RGB. A PC is connected to the liquid crystal display monitor, while an optical sensor is attached to a display screen of the LCD panel. On the basis of brightness (white brightness and single color brightness) and white chromaticity having been acquired in a state that a white screen is displayed at a plurality of gradations of display input gradation, a conversion table for a plurality of colors (each color of RGB) is calibrated so that display characteristics of a color display unit is calibrated.

40 Claims, 9 Drawing Sheets

DISPLAY CHARACTERISTICS CALIBRATION METHOD, DISPLAY CHARACTERISTICS CALIBRATION APPARATUS, AND COMPUTER PROGRAM

This application is the national phase under 35 U.S.C. §371 of PCT International Application No. PCT/JP2004/15502 having an International filing date of Oct. 20, 2004, which designated the United States of America.

TECHNICAL FIELD

The present invention relates to a display characteristics calibration method, a display characteristics calibration apparatus, and a computer program that calibrate the conversion table of a color display unit having a conversion table for converting a display input gradation into a display output gradation and that thereby calibrate the display characteristics of the color display unit.

BACKGROUND ART

A color display unit (such as a color liquid crystal display unit) provided with a color display section (such as a liquid crystal color display section) performs display at brightness (such as lightness and transmittance of light) corresponding to the gradation of a signal provided to the color display section. Characteristics proper to the color display section arises between the gradation (gradation value) in the provided signal and the displayed brightness. Thus, in such a display unit in order that display should be performed in desired display characteristics (generally referred to as the γ characteristics) for the signal inputted to the display unit, the inputted signal is converted on the basis of a predetermined function. And after that, the signal is provided to the color display section.

As the means for performing this conversion, the color display unit comprises, in the inside, a conversion table (referred to a look-up table) for converting a display input gradation (a signal inputted to the display unit) into a display output gradation (a signal outputted after the conversion of the display input signal for the purpose of adjustment of the proper characteristics of the color display section).

In a prior art color liquid crystal display unit, a conversion table has been provided for each of the colors of R(red), G(green), and B (blue). Then, the γ characteristics has been adjusted using a single color screen for each color of RGB, so that each conversion table has been set up for each color of RGB (see, for example, Patent Document 1). Nevertheless, in a color display unit (a color liquid crystal display unit), additive color mixing does not hold exactly. Thus, when white (monochrome) is displayed using the conversion tables in each of which the γ characteristics has been adjusted for each individual single color of RGB, the γ characteristics deviates from the intrinsic γ characteristics of white. Such deviation in the γ characteristics of white causes a problem, for example, that when the color liquid crystal display unit is used for monochrome display, gradation display is not accurately performed. For example, when a roentgen photography image is displayed using a color liquid crystal display unit, higher accuracy is required in the γ characteristics of white.

[Patent Document 1] Japanese Patent Application Laid-Open No. 2002-99238.

DISCLOSURE OF THE INVENTION

The present invention has been devised in view of such a problem. An object of the present invention is to provide: a display characteristics calibration method for calibrating display characteristics of a color display unit; a display characteristics calibration apparatus for calibrating display characteristics of a color display unit; and a computer program for causing a computer to execute calibration of display characteristics of a color display unit, which are achieved by calibrating a conversion table for a plurality of colors (each color of RGB) on the basis of brightness (white brightness and single color brightness) and white chromaticity acquired in a state that a white screen is displayed at a plurality of gradations of display input gradation for the purpose of improving the accuracy in the γ characteristics at the time of displaying white in gradation display.

Another object of the present invention is to provide a display characteristics calibration method, a display characteristics calibration apparatus, and a computer program which are applied to a color liquid crystal display unit where exact additive color mixing does not hold, and which thereby achieve accurate γ characteristics in the case of white display.

A display characteristics calibration method according to the present invention is characterized by a display characteristics calibration method for calibrating display characteristics of a color display unit provided with a conversion section having a conversion table for converting a display input gradation into a display output gradation for a plurality of colors and with a color display section for performing display in accordance with the display output gradation outputted from the conversion section, comprising the steps of calibrating the conversion section such that the color display section should show predetermined brightness and predetermined white chromaticity at a predetermined gradation of display input gradation; displaying a white screen in correspondence to the display input gradation; acquiring single color brightness of the plurality of colors from the displayed white screen, then applying a display output gradation corresponding to the display input gradation, and thereby acquiring correlation of display output gradation versus single color brightness; calculating target white brightness for a plurality of gradations of display input gradation by using predetermined display characteristics and white brightness at the predetermined gradation; distributing the target white brightness at a single color brightness ratio of the predetermined gradation and thereby acquiring target single color brightness for a plurality of gradations of display input gradation; acquiring a display output gradation that indicates brightness corresponding to the target single color brightness for a plurality of gradations of display input gradation, from the correlation of display output gradation versus single color brightness; and establishing correspondence between the acquired display output gradation and the display input gradation and thereby calibrating the conversion table.

A display characteristics calibration method according to the present invention is characterized by a display characteristics calibration method for calibrating display characteristics of a color display unit provided with a conversion section having a conversion table for converting a display input gradation into a display output gradation for a plurality of colors and with a color display section for performing display in accordance with the display output gradation outputted from the conversion section, comprising the steps of: a first step of setting into the maximum gradation the display input gradation of the conversion table for a plurality of colors, then adjusting the display output gradation of the conversion table for a plurality of colors, and thereby acquiring an initial-calibration use display output gradation that causes brightness and white chromaticity of the color display section to become tentative target brightness and target white chromaticity; a second step of establishing correspondence between the maximum gradation of the display input gradation and the initial-calibration use display output gradation, and thereby performing initial calibration of the conversion table for a plurality of colors such that the correlation between the display input gradation and the display output gradation should become a predetermined function; a third step of displaying a white screen at a plurality of gradations of display input gradation by using the conversion table for a plurality of colors having undergone the initial calibration; a fourth step of acquiring single color brightness of a plurality of colors for a plurality of gradations of display input gradation from the white screen, then applying a display output gradation corresponding to the display input gradation, and thereby acquiring primary display output gradation versus single color brightness correlation characteristics of a plurality of colors; a fifth step of calculating primary target white brightness for a plurality of gradations of display input gradation by using target display characteristics having been set up in advance as well as white brightness of the case that the display input gradation is at the maximum gradation and white brightness of the case that the display input gradation is at the minimum gradation which have been acquired from the white screen, and thereby acquiring primary display input gradation versus target white brightness correlation characteristics; a sixth step of proportionally distributing the primary target white brightness for a plurality of gradations of display input gradation by using the ratio of the single color brightness of a plurality of colors of the case that the display input gradation is at the maximum gradation, thereby calculating target single color brightness for a plurality of gradations of display input gradation, and thereby acquiring primary display input gradation versus target single color brightness correlation characteristics of a plurality of colors; and a seventh step of acquiring a display output gradation that indicates brightness corresponding to the target single color brightness in the primary display input gradation versus target single color brightness correlation characteristics of a plurality of colors for a plurality of gradations of display input gradation, as a calibration-use display output gradation on the basis of the primary display output gradation versus single color brightness correlation characteristics, then establishing correspondence between the calibration-use display output gradation and the display input gradation, and thereby calibrating the conversion table for a plurality of colors.

A display characteristics calibration method according to the present invention is characterized by further comprising after the seventh step: an eighth step of displaying a calibration white screen at a plurality of gradations of display input gradation by using the calibrated conversion table of a plurality of colors; a ninth step of acquiring single color brightness of a plurality of colors for a plurality of gradations of display input gradation from the calibration white screen, then applying a display output gradation corresponding to the display input gradation, and thereby acquiring secondary display output gradation versus single color brightness correlation characteristics of a plurality of colors; and a tenth step of acquiring a display output gradation that indicates brightness corresponding to the target single color brightness in the primary display input gradation versus target single color brightness correlation characteristics of a plurality of colors for a plurality of gradations of display input gradation, as a calibration-use display output gradation on the basis of the secondary display output gradation versus single color brightness correlation characteristics, then establishing correspondence between the calibration-use display output gradation and the display input gradation, and thereby calibrating the conversion table for a plurality of colors.

A display characteristics calibration method according to the present invention is characterized in that the eighth step through the tenth step are repeated so that the secondary display output gradation versus single color brightness correlation characteristics should converge.

A display characteristics calibration method according to the present invention is characterized by further comprising: an eleventh step of calculating secondary target white brightness for a plurality of gradations of display input gradation by using the target display characteristics as well as target brightness at the maximum gradation of the display input gradation and target brightness at the minimum gradation which have been set up in advance, and thereby acquiring secondary display input gradation versus target white brightness correlation characteristics; a twelfth step of proportionally distributing the secondary target white brightness for a plurality of gradations of display input gradation by using the ratio of the single color brightness, thereby calculating target single color brightness of a plurality of colors for a plurality of gradations of display input gradation, and thereby acquiring secondary display input gradation versus target single color brightness correlation characteristics of a plurality of colors; and a thirteenth step of acquiring a display output gradation that indicates brightness corresponding to the target single color brightness in the secondary display input gradation versus target single color brightness correlation characteristics of a plurality of colors for a plurality of gradations of display input gradation, as a calibration-use display output gradation on the basis of the converged secondary display output gradation versus single color brightness correlation characteristics, then establishing correspondence between the calibration-use display output gradation and the display input gradation, and thereby calibrating the conversion table for a plurality of colors.

A display characteristics calibration method according to the present invention is characterized in that the tentative target brightness is set greater than the target brightness at the maximum gradation.

A display characteristics calibration method according to the present invention is characterized in that the plurality of colors are red, green, and blue.

A display characteristics calibration method according to the present invention is characterized in that the initial-calibration use display output gradation is adjusted such that the initial-calibration use display output gradation of any one of the plurality of colors should become the maximum gradation of output gradation.

A display characteristics calibration method according to the present invention is characterized in that the plurality of gradations of display input gradation are all gradations of display input gradation.

A display characteristics calibration method according to the present invention is characterized in that the color display unit is a color liquid crystal display unit.

A display characteristics calibration apparatus according to the present invention is characterized by a display characteristics calibration apparatus for calibrating display characteristics of a color display unit provided with a conversion section having a conversion table for converting a display input gradation into a display output gradation for a plurality of colors and with a color display section for performing display in accordance with the display output gradation outputted from the conversion section, comprising an optical sensor for measuring brightness and white chromaticity of the color display section and a control section for controlling the processing of calibrating the display characteristics, wherein the control section controls the processing of: a first step of setting into the maximum gradation the display input gradation of the conversion table for a plurality of colors, then adjusting the display output gradation of the conversion table for a plurality of colors, then measuring brightness and white chromaticity of the color display section through the optical sensor, and thereby acquiring an initial-calibration use display output gradation that causes the brightness and the white chromaticity to become target brightness and target white chromaticity; a second step of establishing correspondence between the maximum gradation of the display input gradation and the initial-calibration use display output gradation, and thereby performing initial calibration of the conversion table for a plurality of colors such that the correlation between the display input gradation and the display output gradation should become a predetermined function; a third step of displaying a white screen at a plurality of gradations of display input gradation by using the conversion table for a plurality of colors having undergone the initial calibration; a fourth step of measuring single color brightness of a plurality of colors for a plurality of gradations of display input gradation in the white screen through the optical sensor, then applying a display output gradation corresponding to the display input gradation, and thereby acquiring display output gradation versus single color brightness correlation characteristics of a plurality of colors; a fifth step of calculating target white brightness for a plurality of gradations of display input gradation by using target display characteristics having been set up in advance as well as white brightness of the case that the display input gradation is at the maximum gradation and white brightness of the case that the display input gradation is at the minimum gradation which have been acquired from the white screen, and thereby acquiring display input gradation versus target white brightness correlation characteristics; a sixth step of proportionally distributing the target white brightness for a plurality of gradations of display input gradation by using the ratio of the single color brightness of a plurality of colors of the case that the display input gradation is at the maximum gradation, thereby calculating target single color brightness for a plurality of gradations of display input gradation, and thereby acquiring display input gradation versus target single color brightness correlation characteristics of a plurality of colors; and a seventh step of acquiring a display output gradation that indicates brightness corresponding to the target single color brightness in the display input gradation versus target single color brightness correlation characteristics of a plurality of colors for a plurality of gradations of display input gradation, as a calibration-use display output gradation on the basis of the display output gradation versus single color brightness correlation characteristics, then establishing correspondence between the calibration-use display output gradation and the display input gradation, and thereby calibrating the conversion table for a plurality of colors.

A display characteristics calibration apparatus according to the present invention is characterized in that the color display unit is a color liquid crystal display unit provided with a backlight, and that at the first step, brightness of the backlight is controlled in parallel.

A display characteristics calibration apparatus according to the present invention is characterized in that the brightness measured by the optical sensor is expressed by an absolute value.

A display characteristics calibration apparatus according to the present invention is characterized in that the optical sensor is capable of measuring brightness and chromaticity, so that single color brightness is calculated from the measured brightness and chromaticity.

A computer program according to the present invention is characterized by a computer program for causing a computer to execute calibration of display characteristics of a color display unit provided with a conversion section having a conversion table for converting a display input gradation into a display output gradation for a plurality of colors and with a color display section for performing display in accordance with said display output gradation outputted from the conversion section, causing the computer to execute: a first step of setting into the maximum gradation the display input gradation of the conversion table for a plurality of colors, then adjusting the display output gradation of the conversion table for a plurality of colors, then acquiring brightness and white chromaticity of the color display section, and thereby acquiring an initial-calibration use display output gradation that causes the brightness and the white chromaticity to become target brightness and target white chromaticity; a second step of establishing correspondence between the maximum gradation of the display input gradation and the initial-calibration use display output gradation, and thereby performing initial calibration of the conversion table for a plurality of colors such that the correlation between the display input gradation and the display output gradation should become a predetermined function; a third step of displaying a white screen at a plurality of gradations of display input gradation by using the conversion table for a plurality of colors having undergone the initial calibration; a fourth step of acquiring single color brightness of a plurality of colors for a plurality of gradations of display input gradation from the white screen, then applying a display output gradation corresponding to the display input gradation, and thereby acquiring display output gradation versus single color brightness correlation characteristics of a plurality of colors; a fifth step of calculating target white brightness for a plurality of gradations of display input gradation by using target display characteristics having been set up in advance as well as white brightness of the case that the display input gradation is at the maximum gradation and white brightness of the case that the display input gradation is at the minimum gradation which have been acquired from the white screen, and thereby acquiring display input gradation versus target white-brightness correlation characteristics; a sixth step of proportionally distributing the target white brightness for a plurality of gradations of display input gradation by using the ratio of the single color brightness of a plurality of colors of the case that the display input gradation is at the maximum gradation, thereby calculating target single color brightness for a plurality of gradations of display input gradation, and thereby acquiring display input gradation versus target single color brightness correlation characteristics of a plurality of colors; and a seventh step of acquiring a display output gradation that indicates brightness corresponding to the target single color brightness in the display input gradation versus target single color brightness correlation characteristics of a plurality of colors for a plurality of gradations of display input gradation, as a calibration-use display output gradation on the basis of the display output gradation versus single color brightness correlation characteristics, then establishing correspondence between the calibration-use display output gradation and the display input gradation, and thereby calibrating the conversion table for a plurality of colors.

A display characteristics calibration method according to the present invention is characterized by a display characteristics calibration method for calibrating display characteristics of a color display unit provided with: a conversion section having a conversion table for converting a display input gradation into a display output gradation for a plurality of colors; a gain adjustment section for multiplying the display output gradation outputted from the conversion section, by a predetermined gain constant specific to each of a plurality of colors, and then outputting the result as an adjustment gradation; and a color display section for performing display in accordance with the adjustment gradation, comprising the steps of: establishing correspondence between the correlation of the display input gradation with the display output gradation and a predetermined function and thereby calibrating the conversion table; setting up the gain constant such that the color display section should display predetermined brightness and predetermined white chromaticity at a predetermined gradation of display input gradation of the calibrated conversion table; displaying, after setting up the gain constant, a single color screen of each of a plurality of colors and thereby acquiring single color screen brightness of each of a plurality of colors; displaying, after setting up the gain constant, a white screen at a plurality of gradations of display input gradation and thereby acquiring white brightness and single color brightness of a plurality of colors; distributing the white brightness at the ratio of the single color brightness of a plurality of colors for the display input gradation with reference to the single color screen brightness, thereby calculating single color brightness for a plurality of gradations of display input gradation, then applying a display output gradation corresponding to the display input gradation, and thereby acquiring correlation of display output gradation versus single color brightness of a plurality of colors; calculating target white brightness for a plurality of gradations of display input gradation by using predetermined display characteristics and target brightness of the case that the display input gradation is at a predetermined gradation, and thereby acquiring correlation of display input gradation versus target white brightness; distributing the target white brightness at the display input gradation versus target white brightness at the ratio of the single color screen brightness, and thereby calculating target single color brightness for a plurality of gradations of display input gradation; acquiring a display output gradation that indicates brightness corresponding to the target single color brightness for a plurality of gradations of display input gradation, from the correlation of display output gradation versus single color brightness; and establishing correspondence between the acquired display output gradation and the display input gradation and thereby calibrating the conversion table.

A display characteristics calibration method according to the present invention is characterized by a display characteristics calibration method for calibrating display characteristics of a color display unit provided with: a conversion section having a conversion table for converting a display input gradation into a display output gradation for a plurality of colors; a gain adjustment section for multiplying the display output gradation outputted from the conversion section, by a predetermined gain constant specific to each of a plurality of colors, and then outputting the result as an adjustment gradation; and a color display section for performing display in accordance with the adjustment gradation, comprising: a first step of establishing correspondence between the correlation of the display input gradation with the display output gradation and a predetermined function and thereby performing initial calibration of the conversion table for a plurality of colors; a second step of setting into the maximum gradation the display input gradation of the conversion table for a plurality of colors having undergone the initial calibration, and then setting up the gain constant such that the brightness and the white chromaticity of the color display section should become tentative target brightness and target white chromaticity; a third step of displaying, after setting up the gain constant, a single color screen of each of a plurality of colors and thereby acquiring primary single color screen brightness of a plurality of colors; a fourth step of displaying, after setting up the gain constant, a white screen at a plurality of gradations of display input gradation and thereby acquiring white brightness and primary single color brightness of a plurality of colors; a fifth step of applying a display output gradation corresponding to the display input gradation, to the single color brightness for a plurality of gradations of display input gradation, and thereby acquiring primary display output gradation versus single color brightness correlation characteristics of a plurality of colors; a sixth step of calculating primary target white brightness for a plurality of gradations of display input gradation by using target display characteristics having been set up in advance as well as tentative target brightness of the case that the display input gradation is at the maximum gradation and tentative target brightness of the case that the display input gradation is at the minimum gradation which have been set up in advance, and thereby acquiring primary display input gradation versus target white brightness correlation characteristics; a seventh step of proportionally distributing the primary target white brightness for a plurality of gradations of display input gradation by using the ratio of the primary single color screen brightness of a plurality of colors, thereby calculating target single color brightness for a plurality of gradations of display input gradation, and thereby acquiring primary display input gradation versus target single color brightness correlation characteristics of a plurality of colors; and an eighth step of acquiring a display output gradation that indicates brightness corresponding to the target single color brightness in the primary display input gradation versus target single color brightness correlation characteristics of a plurality of colors for a plurality of gradations of display input gradation, as a calibration-use display output gradation on the basis of the primary display output gradation versus single color brightness correlation characteristics, then establishing correspondence between the calibration-use display output gradation and the display input gradation, and thereby calibrating the conversion table for a plurality of colors.

A display characteristics calibration method according to the present invention is characterized by further comprising after the eighth step: a ninth step of displaying a single color screen of each of a plurality of colors and thereby acquiring secondary single color screen brightness of a plurality of colors; a tenth step of displaying a white screen at a plurality of gradations of display input gradation and thereby acquiring white brightness and secondary single color brightness of a plurality of colors; an eleventh step of applying a display output gradation corresponding to the display input gradation, to the single color brightness for a plurality of gradations of display input gradation, and thereby acquiring secondary display output gradation versus single color brightness correlation characteristics of a plurality of colors; a twelfth step of calculating secondary target white brightness for a plurality of gradations of display input gradation by using target display characteristics having been set up in advance as well as target brightness of the case that the display input gradation is at the maximum gradation and target brightness of the case that the display input gradation is at the minimum gradation which have been set up in advance, and thereby acquiring secondary display input gradation versus target white brightness correlation characteristics; a thirteenth step of proportionally distributing the secondary target white brightness for a plurality of gradations of display input gradation by using the ratio of the secondary single color screen brightness of a plurality of colors, thereby calculating target single color brightness for a plurality of gradations of display input gradation, and thereby acquiring secondary display input gradation versus target single color brightness correlation characteristics of a plurality of colors; and a fourteenth step of acquiring a display output gradation that indicates brightness corresponding to the target single color brightness in the secondary display input gradation versus target single color brightness correlation characteristics of a plurality of colors for a plurality of gradations of display input gradation, as a calibration-use display output gradation on the basis of the secondary display output gradation versus single color brightness correlation characteristics, then establishing correspondence between the calibration-use display output gradation and the display input gradation, and thereby calibrating the conversion table for a plurality of colors.

A display characteristics calibration method according to the present invention is characterized by further comprising after the eighth step: a fifteenth step of displaying a white screen at a plurality of gradations of display input gradation, thereby acquiring white brightness, then applying a display output gradation corresponding to the display input gradation, and thereby acquiring display output gradation versus white brightness correlation characteristics; a sixteenth step of calculating secondary target white brightness for a plurality of gradations of display input gradation by using target display characteristics having been set up in advance as well as target brightness of the case that the display input gradation is at the maximum gradation and target brightness of the case that the display input gradation is at the minimum gradation which have been set up in advance, and thereby acquiring secondary display input gradation versus target white brightness correlation characteristics; and a seventeenth step of acquiring a display output gradation that indicates brightness corresponding to the secondary target white brightness in the secondary display input gradation versus white brightness correlation characteristics for a plurality of gradations of display input gradation, as a calibration-use display output gradation on the basis of the display output gradation versus white brightness correlation characteristics, then establishing correspondence between the calibration-use display output gradation and the display input gradation, and thereby calibrating the conversion table for a plurality of colors.

A display characteristics calibration method according to the present invention is characterized in that the tentative target brightness and the target brightness have a relation that the tentative target brightness at the second step>the tentative target brightness at the maximum gradation at the sixth step>the target brightness at the maximum gradation at the twelfth step or the sixteenth step.

A display characteristics calibration method according to the present invention is characterized in that the plurality of colors are red, green, and blue.

A display characteristics calibration method according to the present invention is characterized in that the gain constant is such that the gain constant of any one of a plurality of colors is set at the maximum.

A display characteristics calibration method according to the present invention is characterized in that the plurality of gradations of input gradation are all gradations of input gradation.

A display characteristics calibration method according to the present invention is characterized in that the color display unit is a color liquid crystal display unit.

A display characteristics calibration apparatus according to the present invention is characterized by a display characteristics calibration apparatus for calibrating display characteristics of a color display unit provided with: a conversion section having a conversion table for converting a display input gradation into a display output gradation for a plurality of colors; a gain adjustment section for multiplying the display output gradation outputted from the conversion section, by a predetermined gain constant specific to each of a plurality of colors, and then outputting the result as an adjustment gradation; and a color display section for performing display in accordance with the adjustment gradation, comprising an optical sensor for measuring brightness and white chromaticity of the color display section and a control section for controlling the processing of calibrating the display characteristics, wherein the control section controls the processing of: a first step of establishing correspondence between the correlation of the display input gradation with the display output gradation and a predetermined function and thereby performing initial calibration of the conversion table; a second step of setting into the maximum gradation the display input gradation of the conversion table for a plurality of colors having undergone the initial calibration, then measuring brightness and white chromaticity of the color display section through the optical sensor, and then setting up the gain constant such that the brightness and the white chromaticity should become target brightness and target white chromaticity; a third step of displaying, after setting up the gain constant, a single color screen of each of a plurality of colors and then measuring single color screen brightness of a plurality of colors through the optical sensor; a fourth step of displaying, after setting up the gain constant, a white screen at a plurality of gradations of display input gradation and then measuring white brightness and single color brightness of a plurality of colors through the optical sensor; a fifth step of applying a display output gradation corresponding to the display input gradation, to the single color brightness for a plurality of gradations of display input gradation, and thereby acquiring display output gradation versus single color brightness correlation characteristics of a plurality of colors; a sixth step of calculating target white brightness for a plurality of gradations of display input gradation by using target display characteristics having been set up in advance as well as target brightness of the case that the display input gradation is at the maximum gradation and target brightness of the case that the display input gradation is at the minimum gradation which have been set up in advance, and thereby acquiring display input gradation versus target white brightness correlation characteristics; a seventh step of proportionally distributing the target white brightness for a plurality of gradations of display input gradation by using the ratio of the single color screen brightness of a plurality of colors, thereby calculating target single color brightness for a plurality of gradations of display input gradation, and thereby acquiring display input gradation versus target single color brightness correlation characteristics of a plurality of colors; and an eighth step of acquiring a display output gradation that indicates brightness corresponding to the target single color brightness in the display input gradation versus target single color brightness correlation characteristics of a plurality of colors for a plurality of gradations of display input gradation, as a calibration-use display output gradation on the basis of the display output gradation versus single color brightness correlation characteristics, then establishing correspondence between the calibration-use display output gradation and the display input gradation, and thereby calibrating the conversion table for a plurality of colors.

A display characteristics calibration apparatus according to the present invention is characterized in that the color display unit is a color liquid crystal display unit provided with a backlight, and that at the second step, brightness of the backlight is controlled in parallel.

A display characteristics calibration apparatus according to the present invention is characterized in that the single color brightness of a plurality of colors measured by the optical sensor is expressed by a relative value, and that the single color brightness is normalized so that the single color brightness at the fifth step is calculated.

A display characteristics calibration apparatus according to the present invention is characterized in that the optical sensor is capable of measuring brightness and chromaticity, so that the single color brightness at the fourth step is calculated from the measured brightness and chromaticity.

A computer program according to the present invention is characterized by a computer program for causing a computer to execute calibration of display characteristics of a color display unit provided with: a conversion section having a conversion table for converting a display input gradation into a display output gradation for a plurality of colors; a gain adjustment section for multiplying the display output gradation outputted from the conversion section, by a predetermined gain constant specific to each of a plurality of colors, and then outputting the result as an adjustment gradation; and a color display section for performing display in accordance with the adjustment gradation, causing the computer to execute: a first step of establishing correspondence between the correlation of the display input gradation with the display output gradation and a predetermined function and thereby performing initial calibration of the conversion table; a second step of setting into the maximum gradation the display input gradation of the conversion table for a plurality of colors having undergone the initial calibration, and then setting up the gain constant such that the brightness and the white chromaticity of the color display section should become tentative target brightness and target white chromaticity; a third step of displaying, after setting up the gain constant, a single color screen of each of a plurality of colors and thereby acquiring primary single color screen brightness of a plurality of colors; a fourth step of displaying, after setting up the gain constant, a white screen at a plurality of gradations of display input gradation and thereby acquiring white brightness and primary single color brightness of a plurality of colors; a fifth step of applying a display output gradation corresponding to the display input gradation, to the single color brightness for a plurality of gradations of display input gradation, and thereby acquiring primary display output gradation versus single color brightness correlation characteristics of a plurality of colors; a sixth step of calculating primary target white brightness for a plurality of gradations of display input gradation by using target display characteristics having been set up in advance as well as tentative target brightness of the case that the display input gradation is at the maximum gradation and tentative target brightness of the case that the display input gradation is at the minimum gradation which have been set up in advance, and thereby acquiring primary display input gradation versus target white brightness correlation characteristics; a seventh step of proportionally distributing the primary target white brightness for a plurality of gradations of display input gradation by using the ratio of the primary single color screen brightness of a plurality of colors, thereby calculating target single color brightness for a plurality of gradations of display input gradation, and thereby acquiring primary display input gradation versus target single color brightness correlation characteristics of a plurality of colors; and an eighth step of acquiring a display output gradation that indicates brightness corresponding to the target single color brightness in the primary display input gradation versus target single color brightness correlation characteristics of a plurality of colors for a plurality of gradations of display input gradation, as a calibration-use display output gradation on the basis of the primary display output gradation versus single color brightness correlation characteristics, then establishing correspondence between the calibration-use display output gradation and the display input gradation, and thereby calibrating the conversion table for a plurality of colors.

A computer program according to the present invention is characterized by causing the computer to execute after the eighth step: a ninth step of displaying a single color screen of each of a plurality of colors and thereby acquiring secondary single color screen brightness of a plurality of colors; a tenth step of displaying a white screen at a plurality of gradations of display input gradation and thereby acquiring white brightness and secondary single color brightness of a plurality of colors; an eleventh step of normalizing each of the secondary single color brightness of a plurality of colors for the display input gradation with reference to the secondary single color screen brightness, then proportionally distributing the white brightness acquired at the tenth step, by using the ratio of the normalized secondary single color brightness of a plurality of colors, thereby calculating single color brightness for a plurality of gradations of display input gradation, then applying a display output gradation corresponding to the display input gradation, and thereby acquiring secondary display output gradation versus single color brightness correlation characteristics of a plurality of colors; a twelfth step of calculating secondary target white brightness for a plurality of gradations of display input gradation by using target display characteristics having been set up in advance as well as target brightness of the case that the display input gradation is at the maximum gradation and target brightness of the case that the display input gradation is at the minimum gradation which have been set up in advance, and thereby acquiring secondary display input gradation versus target white brightness correlation characteristics; a thirteenth step of proportionally distributing the secondary target white brightness for a plurality of gradations of display input gradation by using the ratio of the secondary single color screen brightness of a plurality of colors, thereby calculating target single color brightness for a plurality of gradations of display input gradation, and thereby acquiring secondary display input gradation versus target single color brightness correlation characteristics of a plurality of colors; and a fourteenth step of acquiring a display output gradation that indicates brightness corresponding to the target single color brightness in the secondary display input gradation versus target single color brightness correlation characteristics of a plurality of colors for a plurality of gradations of display input gradation, as a calibration-use display output gradation on the basis of the secondary display output gradation versus single color brightness correlation characteristics then establishing correspondence between the calibration-use display output gradation and the display input gradation, and thereby calibrating the conversion table for a plurality of colors.

A computer program according to the present invention is characterized by causing the computer to execute after the eighth step: a fifteenth step of displaying a white screen at a plurality of gradations of display input gradation, thereby acquiring white brightness, then applying a display output gradation corresponding to the display input gradation, and thereby acquiring display output gradation versus white brightness correlation characteristics; a sixteenth step of calculating secondary target white brightness for a plurality of gradations of display input gradation by using target display characteristics having been set up in advance as well as target brightness of the case that the display input gradation is at the maximum gradation and target brightness of the case that the display input gradation is at the minimum gradation which have been set up in advance, and thereby acquiring secondary display input gradation versus target white brightness correlation characteristics; and a seventeenth step of acquiring a display output gradation that indicates brightness corresponding to the secondary target white brightness in the secondary display input gradation versus white brightness correlation characteristics for a plurality of gradations of display input gradation, as a calibration-use display output gradation on the basis of the display output gradation versus white brightness correlation characteristics, then establishing correspondence between the calibration-use display output gradation and the display input gradation, and thereby calibrating the conversion table for a plurality of colors.

According to the present invention, on the basis of brightness (white brightness and single color brightness) and chromaticity (white chromaticity) acquired in a state that a white screen is displayed at a plurality of gradations of display input gradation, a conversion table for a plurality of colors (each color of RGB) is calibrated so that the display characteristics (γ characteristics) in the case of white display can be controlled more accurately. Thus, the present invention provides a display characteristics calibration method, a display characteristics calibration apparatus, and a computer program for calibrating the display characteristics of a color display unit and thereby achieving remarkably accurate gradation display in monochrome display.

The present invention provides a display characteristics calibration method, a display characteristics calibration apparatus, and a computer program which are applied to a color liquid crystal display unit where exact additive color mixing does not hold, and which thereby achieve accurate display characteristics (γ characteristics) in the case of monochrome display.

The present invention provides: a display characteristics calibration method for calibrating display characteristics of a color display unit; a display characteristics calibration apparatus for calibrating display characteristics of a color display unit; and a computer program for causing a computer to execute calibration of display characteristics of a color display unit, which are achieved by calibrating a conversion table for a plurality of colors (each color of RGB) on the basis of brightness (white brightness and single color brightness) and white chromaticity acquired in a state that a white screen is displayed at a plurality of gradations of display input gradation so that the γ characteristics of white can be controlled remarkably accurately.

According to the present invention, when image display requiring monochrome display is performed (e.g., displaying of a roentgen photography image), since gradation is displayed accurately, monochrome determination of the image can be performed accurately so that a remarkably effective color display unit is realized. In particular, in a color display unit such as a color liquid crystal display unit that performs display using additive color mixing, remarkably good gradation display is achieved in monochrome display.

EXPLANATION OF REFERENCE NUMERALS

Figure 1:
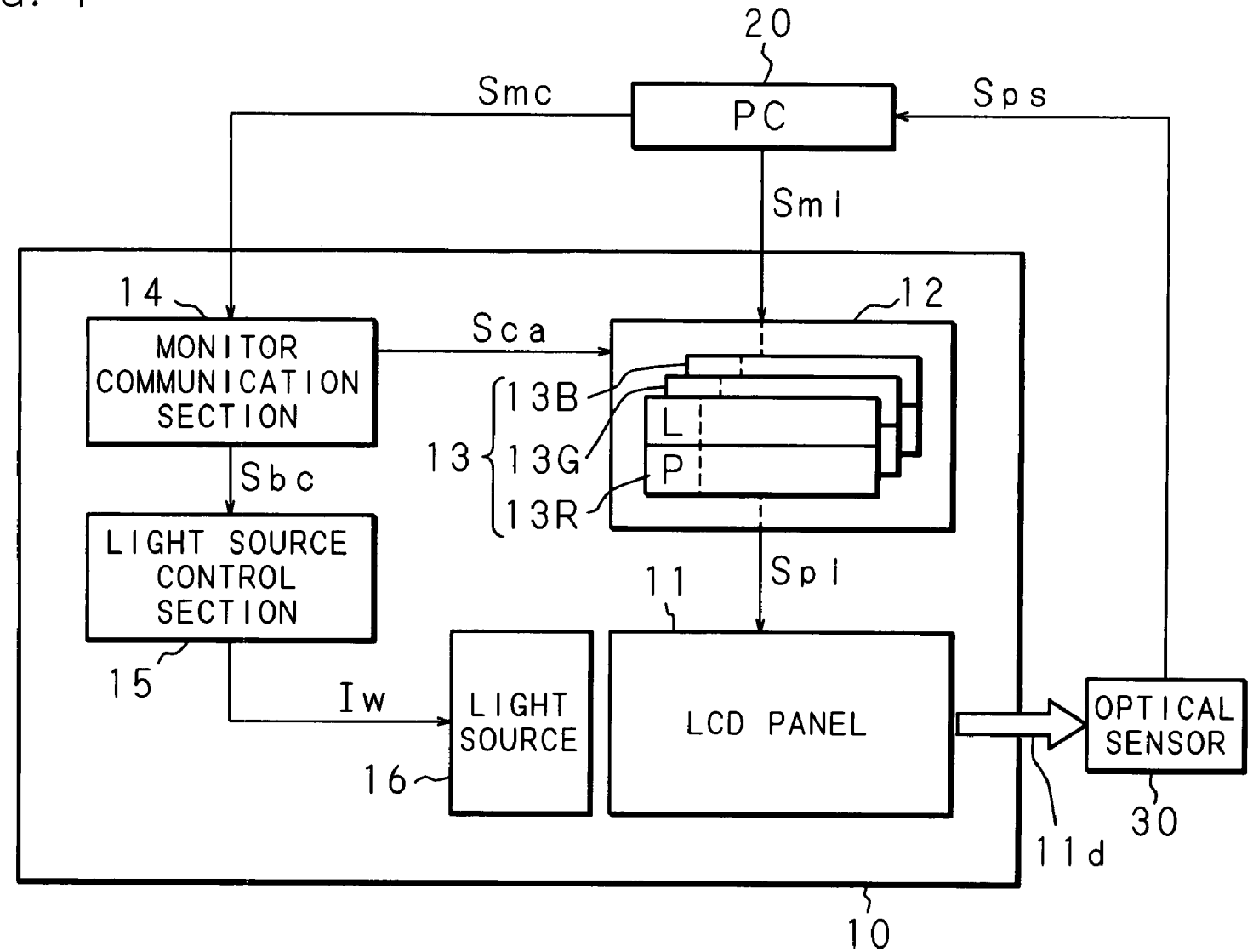
FIG. 1 is a schematic block-diagram of implementation of a display characteristics calibration method according to Embodiment 1 of the present invention.

10 Liquid crystal display monitor
11 LCD panel
12 Conversion section
13 LUT (conversion table)
14 Monitor communication section
15 Light source control section
16 Light source
17 Gain adjustment section
20 PC (computer)
21 CPU (control section)
22 Program storage section
25 Recording medium
30 Optical-sensor
Iw Light source current
L Display input gradation
P Display output gradation

BEST MODE FOR IMPLEMENTING THE INVENTION

The following embodiments are described for an exemplary case that a color liquid crystal display unit is employed as a color display unit and that a color liquid crystal display section is employed as a color display section. However, the present invention is not limited to a color liquid crystal display unit, and may be applied to a cathode-ray tube (CRT) or the like. Further, the three primary colors of RGB are employed as an example of a plurality of colors. However, the present invention is not limited to this.

Embodiment 1

FIG. 1 is a schematic block diagram of implementation of a display characteristics calibration method according to Embodiment 1 of the present invention. Numeral 10 indicates a color liquid crystal display unit (liquid crystal display monitor, hereafter) serving as a color display unit. The liquid crystal display monitor 10 comprises: a color liquid crystal display section (LCD panel, hereafter) 11 serving as a color display section; a conversion section 12; a conversion table (LUT, hereafter) 13; a monitor communication section 14; a light source control section 15; and a light source 16. The conversion section 12 comprises the LUT 13. The LUT 13 comprises a LUT 13R (LUT for red), a LUT 13G (LUT for green), and a LUT 13B (LUT for blue) corresponding to a plurality of colors, specifically to the three primary colors of RGB. The conversion section 12 may be constructed appropriately from a dedicated LSI (ASIC). A computer (PC, hereafter) 20 is connected to the liquid crystal display monitor 10. An optical sensor 30 is attached to a display screen of the LCD panel 11.

In each of the LUTs 13R, 13G, and 13B for each color of RGB, correspondence is established between a display input gradation L and a display output gradation P so that the display input gradation L is converted into the display output gradation P. The display input gradation L is composed for example of 8 bits, and hence permits 256 gradations. That is, the gradation value ranges from gradation 0 to gradation 255. The display output gradation P is composed for example of 10 bits, and hence permits 1024 gradations. That is, the gradation value ranges from gradation 0 to gradation 1023. For example, in the LUT 13R, correspondence is established between each gradation (0, 1, 2, . . . 253, 254, 255) of the display input gradation L and each gradation (0, 2, 5, . . . 988, 1003, 1023) of the display output gradation P. Then, the gradation is converted according to this correspondence, so that correction (γ correction) is performed in correspondence to the display characteristics of the display panel 11.

When the number of bits of the display output gradation P is set greater than the number of bits of the display input gradation L, finer correction can be performed in correspondence to the display characteristics. Further, in addition to the conversion using the LUT 13, when the brightness of the light source 16 is controlled in parallel, the brightness of the LCD panel 11 can be controlled.

A monitor input signal Smi is inputted from the PC 20 to the conversion section 12. The monitor input signal Smi is inputted generally as a signal corresponding to the display input gradation L of the LUT 13. A panel input signal Spi is inputted from the conversion section 12 to the LCD panel 11. The panel input signal Spi is generally inputted as a signal corresponding to the display output gradation P. That is, the monitor input signal Smi (display input gradation L) is converted into the panel input signal Spi (display output gradation P), so that the display characteristics of the LCD panel 11 can be corrected (calibrated). The characteristics of the LCD panel 11 and the light source 16 varies depending on each product. Thus, it is preferable to correct display characteristics for each product. The present invention permits remarkably simple and accurate correction of the display characteristics of each product.

On the basis of a monitor control signal Smc inputted from the PC 20, the monitor communication section 14 outputs a light source control signal Sbc to the light source control section 15. The light source control section 15 provides to the light source 16 a light source current Iw corresponding to the light source control signal Sbc, and thereby adjusts the brightness of the light source 16. The light source control section 15 is constructed from an inverter or the like capable of controlling the light source current Iw by changing the frequency. The light source 16 is constructed from a cathode-ray tube, a light emitting diode, or the like, and is generally referred to as a backlight. The light source control section 15 and the light source 16 are both employed in the case of a transmission type liquid crystal display unit. Further, the light source control section 15 may be constructed in a manner capable of adjusting the chromaticity of the light source 16. Further, on the basis of the monitor control signal Smc inputted from the PC 20, the monitor communication section 14 outputs a calibration signal Sca to the conversion section 12, thereby rewrites the correspondence relation (correlation relation) between the display input gradation L and the display output gradation P in the LUT 13, and thereby calibrates the LUT 13.

The optical sensor 30 is attached in a manner opposing the display screen of the LCD panel 11, and hence can measure display light 11*d* emitted from the LCD panel 11. That is, the white brightness of a white screen as well as the brightness (e.g., the absolute value of brightness) of each color of RGB and the white chromaticity in a white screen can be measured. The optical sensor 30 comprises an R filter, a G filter, and a B filter, thereby performs appropriate spectrometry of the display light from the white screen, and thereby measures the single color brightness of each color of RGB as an absolute value. The measured value of the optical sensor 30 is inputted as an optical sensor signal Sps to the PC 20. At that time, the optical sensor signal Sps is outputted from the optical sensor 30, in a form capable of being processed by the PC 20.

Figure 2:
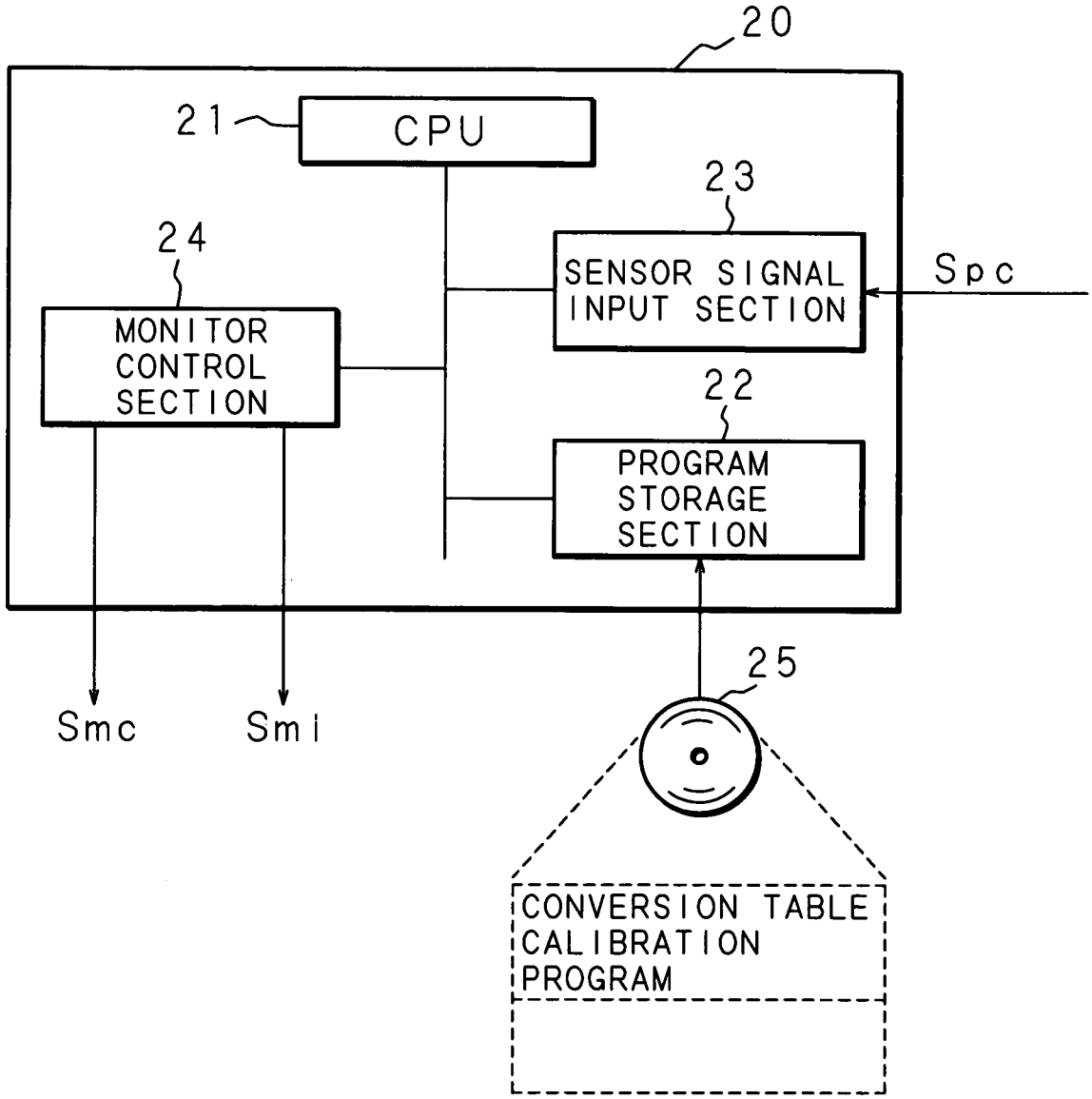
FIG. 2 is a block diagram showing schematic configuration of a computer used in an embodiment of the present invention.

FIG. 2 is a block diagram showing schematic configuration of a computer used in an embodiment of the present invention. In the PC 20, a program storage section 22, a sensor signal input section 23, and a monitor control section 24 are connected to a central processing unit (CPU, hereafter) 21 via a bus. The CPU 21 operates as a control section for performing various kinds of processing according to the present invention, independently or alternatively in cooperation with other components. The program storage section 22 stores a computer program for performing various kinds of processing according to the present invention, and acquires the computer program from an external recording medium 25 such as a CD-ROM that records a conversion table calibration program (a computer program for causing the computer to execute a display characteristics calibration method according to the present invention) and the like.

Since the computer program can be acquired from the outside via the recording medium 25, execution of a display characteristics calibration method according to the present invention becomes remarkably easy. As for the conversion table calibration program, a conversion table calibration program generally known may be applied except for the part relevant to the present invention. The computer program according to the present invention (conversion table calibration program) may be recorded on a recording medium and then circulated for the purpose of display characteristics calibration of a display unit.

The optical sensor signal Sps outputted from the optical sensor 30 is inputted to the sensor signal input section 23. The optical sensor signal Sps is appropriately processed by the CPU 21, so that a display characteristics calibration method according to the present invention is executed. The monitor control section 24 is an interface between the CPU 21 (PC 20) and the liquid crystal display monitor 10, and outputs the monitor input signal Smi to the conversion section 12 and the monitor control signal Smc to the monitor communication section 14.

Figure 3:
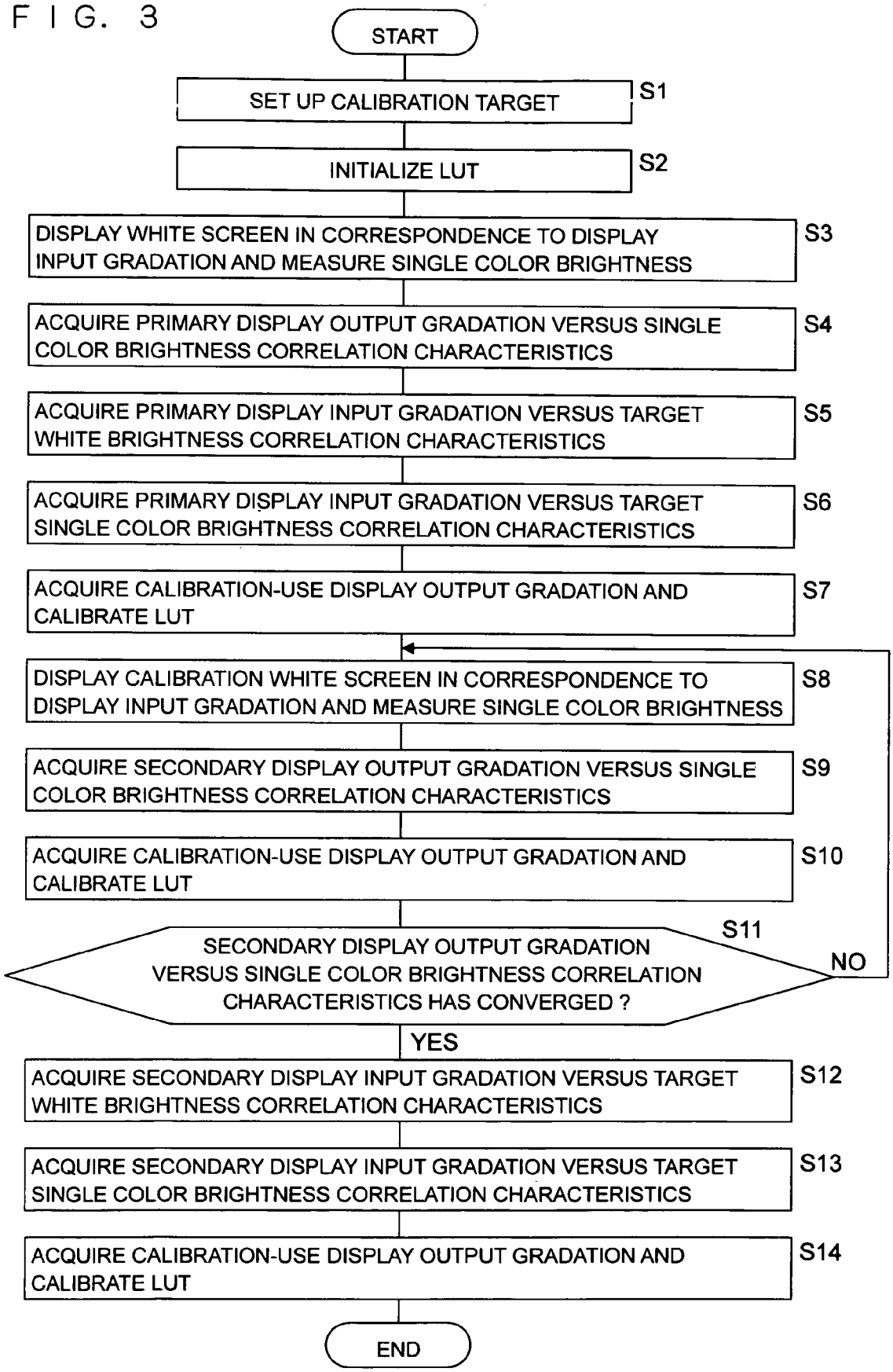
FIG. 3 is a flow chart of executing a display characteristics calibration method according to Embodiment 1 of the present invention.

FIG. 3 is a flow chart of executing a display characteristics calibration method according to Embodiment 1 of the present invention. First, the liquid crystal display monitor 10 and the optical sensor 30 are connected to the PC 20. Then, the conversion table calibration program is started. After that, the following steps are executed. Here, in the following steps, the order of steps is not limited to that described below. Further, when necessity, a specific step may be processed simultaneously in parallel to another step.

Step 1 (S1): A user who is to perform calibration sets up a calibration target. Set up are: target brightness TYmax (the maximum target brightness) of the case that the display input gradation L of each color of RGB is at the maximum gradation L(R,G,B)=(Lr,Lg,Lb)=L(255,255,255); target brightness TYmin (the minimum target brightness) of the case that the display input gradation L of each color of RGB is at the minimum gradation L(R,G,B)=(Lr,Lg,Lb)=L(0,0,0); target white chromaticity (tx,ty); and target γ characteristics. In this setting, a GUI environment is is provided in the computer screen so that the data can be inputted appropriately through a window, a dialog box, or the like. Here, the target white chromaticity (tx,ty) may be replaced by a color temperature.

After the setting of these target values, the PC 20 progresses the processing on the basis of the conversion table calibration program. Once the conversion table calibration program is started, a white screen is displayed. Thus, the optical sensor 30 is attached to that portion, so that the optical characteristics of the display screen is measured. With communicating with the liquid crystal display monitor 10 and the optical sensor 30, the conversion table calibration program progresses the calibration processing for the conversion table (the LUT 13) according to the conversion table calibration program.

Step 2 (S2): The LUT 13 (LUT 13R, LUT 13G, LUT 13B) for each color of RGB is initialized. That is, the display input gradation L of each color is set to be the maximum gradation L(255,255,255), and then a white screen is displayed. In a state that this white screen is displayed, the display output gradation P(R,G,B) of each color is adjusted, and then the brightness and the white chromaticity of the LCD panel 11 are measured by the optical sensor 30. A display output gradation P(R,G,B) that causes the measured brightness and white chromaticity of the LCD panel 11 to become tentative target brightness (1.05×TYmax) and the target white chromaticity (tx,ty) is acquired as an initial-calibration use display output gradation. For example, for the maximum gradation L(255,255,255) of the display input gradation L, a display output gradation P(1023,1018,996) is acquired in an example. At that time, calibration is performed preferably not only with adjusting the display output gradation P but also with adjusting the light source current Iw appropriately.

Correspondence is established between the maximum gradation L(255,255,255) of the display input gradation L and the acquired initial-calibration use display output gradation P(1023,1018,996), and then initial calibration of the LUT 13 (LUT 13R, LUT 13G, LUT 13B) of each color of RGB is performed such that the correlation between the display input gradation L and the display output gradation P should become a predetermined function. The predetermined function may be arbitrary as long as the function clearly defines the correlation between the display input gradation L and the display output gradation P. When the function is linear, the calculation becomes easy. Here, at the time of initial calibration, the tentative target brightness is set greater for example by 5% than the target brightness TYmax (1.05×TYmax). While, the maximum brightness of the LCD panel 11 is basically governed by the light source current Iw. Then, in the LCD panel 11 and the LUT 13 (display input gradation L), adjustment is performed in the direction of reducing the brightness. Thus, in order that a margin of final adjustment should be ensured, the brightness of the white screen is set slightly larger than the target brightness TYmax serving as the final target. Further, for the purpose of effective capability of gradation adjustment for the LUT 13, preferably, any one piece of the initial-calibration use display output gradation P(R,G,B) (any one of Pr, Pg, and Pb) is adjusted into the maximum gradation. Here, as indicated in the display output gradation P(1023,1018,996), the display output gradation Pr of red is set to be the maximum gradation 1023 of display output gradation.

Step 3 (S3): By using the calibrated LUT 13 (LUT 13R, LUT 13G, LUT 13B) for each color of RGB, a white screen is displayed in correspondence to the display input gradation at a plurality of gradations of display input gradation (if necessary, when all gradations are used, more precise calibration can be performed. In the following description, a plurality of gradations are adopted, and this includes the cases of any gradations (e.g., all gradations)). The single color brightness (display input gradation Li: single color brightness Yri,Ygi,Ybi, when i denotes a gradation of the display input gradation L) of each color of RGB for a plurality of gradations of display input gradation is measured in the white screen. The single color brightness is acquired as an absolute value of each color of RGB by the optical sensor 30. Further, the white brightness at a predetermined gradation is also measured in the white screen. Specifically, measured are: the white brightness (Yw255) of the case that the display input gradation L is at the maximum gradation (L255); and the white brightness (Yw0) of the case that the display input gradation L is at the minimum gradation (L0).

Figure 4:
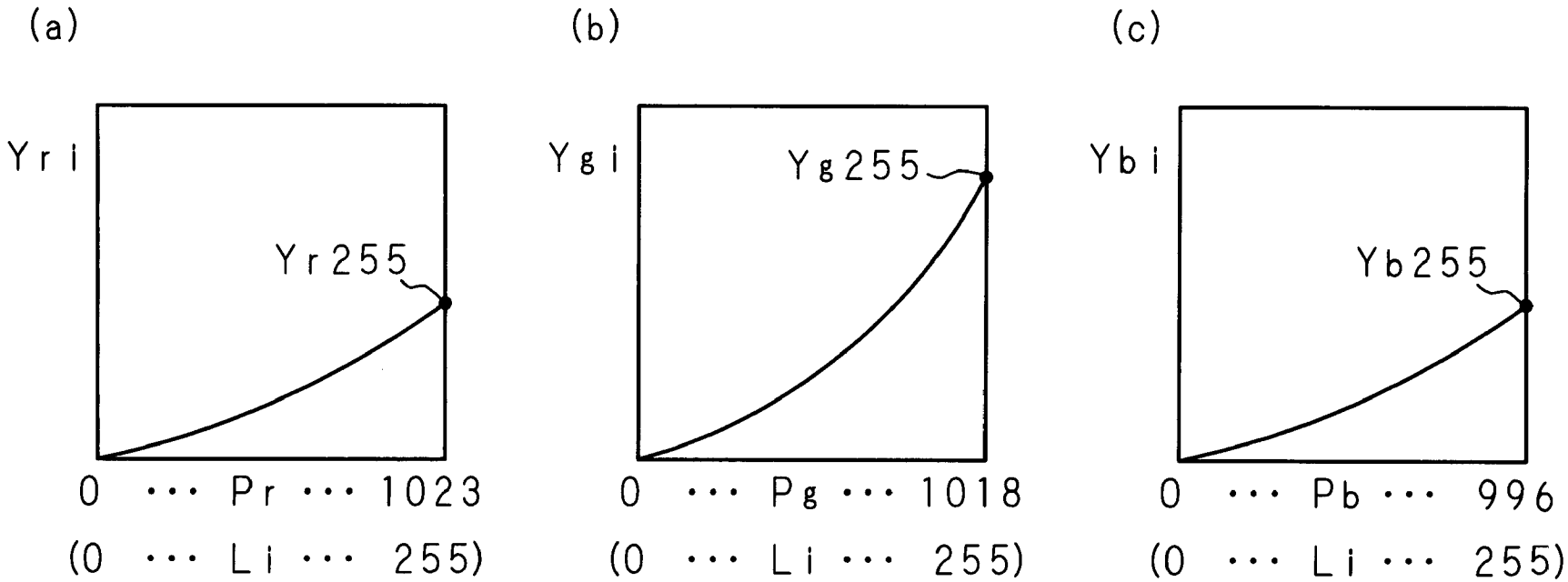
FIG. 4 is a diagram showing primary display output gradation versus single color brightness correlation characteristics acquired in Embodiment 1 of the present invention.

Step 4 (S4): As for the single color brightness of each color of is RGB measured at Step 3, a display output gradation P corresponding to the display input gradation L is applied, so that primary display output gradation versus single color brightness correlation characteristics of each color of RGB (display output gradation Pr: single color brightness Yri for R, display output gradation Pg: single color brightness Ygi for G, and display output gradation Pb: single color brightness Ybi for B) is acquired. This situation is shown in FIG. 4 described later. Here, the phrase "to acquire correlation characteristics" does not indicate that a detailed graph or the like is to be acquired, but indicates that correlation data is stored in a manner permitting arithmetic operation (this definition holds also in the following description).

Figure 5:
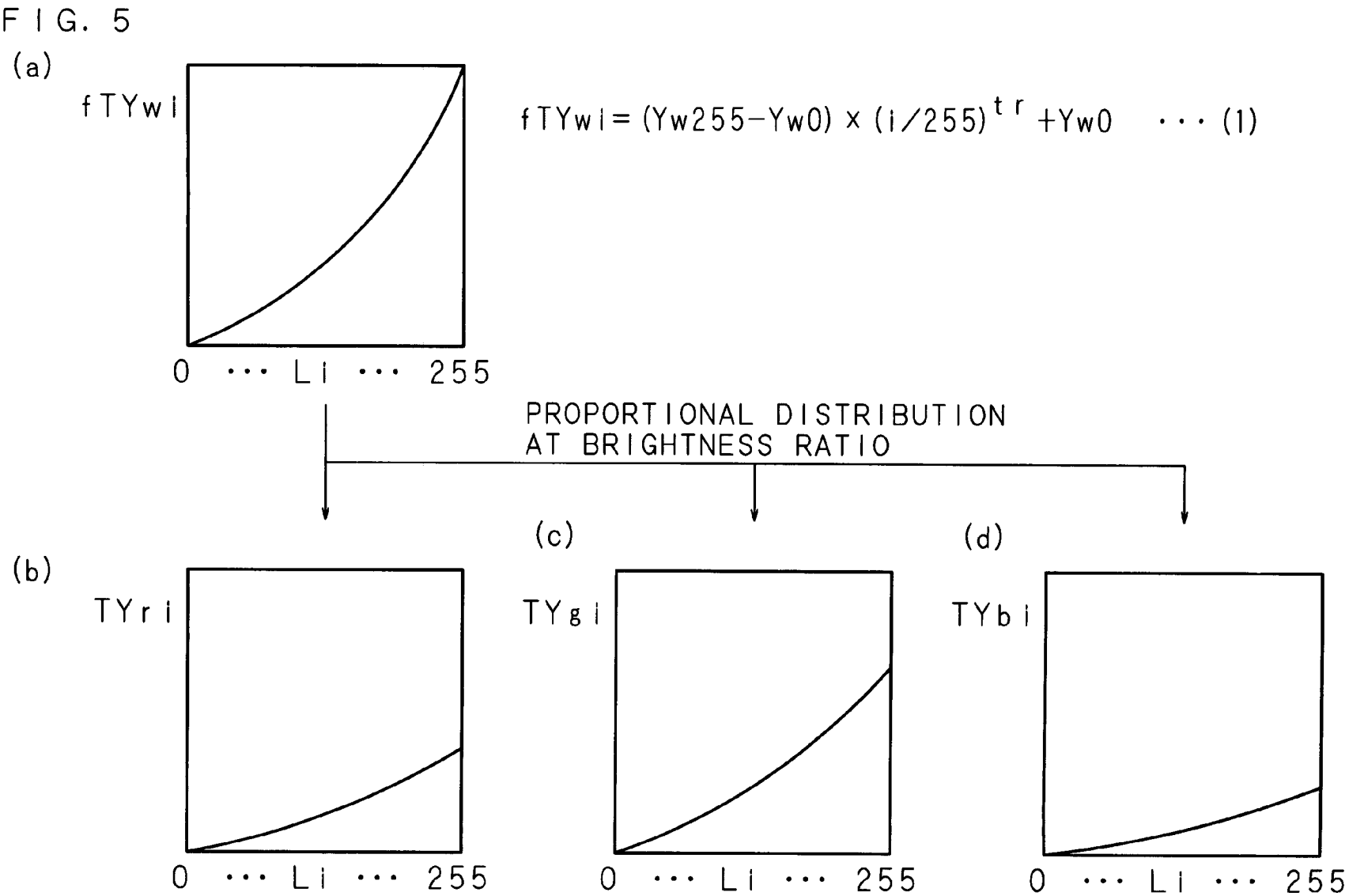
FIG. 5 is a diagram showing primary display input gradation versus target white brightness correlation characteristics and primary display input gradation versus target single color brightness correlation characteristics acquired in Embodiment 1 of the present invention.

Step 5 (S5): By using the target γ characteristics set up in advance as the white brightness Yw255 of the case that the display input gradation is at the maximum gradation and the white brightness Yw0 of the case that the display input gradation is at the minimum gradation which have been acquired from the white screen, primary target white brightness fTYwi for a plurality of gradations of display input gradation is calculated, so that primary display input gradation versus target white brightness correlation characteristics (display input gradation Li: primary target white brightness fTYwi) is acquired. The target γ characteristics can be defined by a formula. When a γ value t γ is used while a display input gradation i is used, Formula (1) holds in an example. Here, the target γ characteristics is set forth in various kinds of standard and the like, and is not limited to that shown in Formula (1). The situation of the target γ characteristics is shown in FIG. 5(*a*) described later.

$$fTYwi=(Yw255-Yw0)\times(i/255)t\,\gamma+Yw0 \quad (1)$$

Step 6 (S6): The ratio of the single color brightness of RGB of the case that the display input gradation L is at the maximum gradation (L255) is acquired as s:t:u=Yr255/(Yr255+Yg255+Yb255): Yg255/(Yr255+Yg255+Yb255): Yb255/(Yr255+Yg255+Yb255). By using the ratio s:t:u (s+t+u=1) of the single color brightness, the primary target white brightness (fTYwi) for a plurality of gradations of the display input gradation L is proportionally distributed (s×fTYwi:t×fTYwi:u×fTYwi) so that target single color brightness TYri (=s×fTYwi), TYgi (=t×fTYwi), TYbi (=u×fTYwi) of each color of RGB for a plurality of gradations of display input gradation is calculated. Thereby, primary display input gradation versus target single color brightness correlation characteristics (display input gradation Li: target single color brightness TYri, TYgi, TYbi) of each color of RGB is acquired. This situation is shown in FIGS. 5(*b*)-5(*d*) described later. When the display input gradation L is at the maximum gradation (L255), the white chromaticity is adjusted into the target white chromaticity (tx,ty). Thus, when target single color brightness for a plurality of gradations of the display input gradation L is acquired by using the brightness ratio of that time, white chromaticity at the target single color brightness at the display input gradation L can be maintained at constant (target white chromaticity is maintained).

Figure 6:
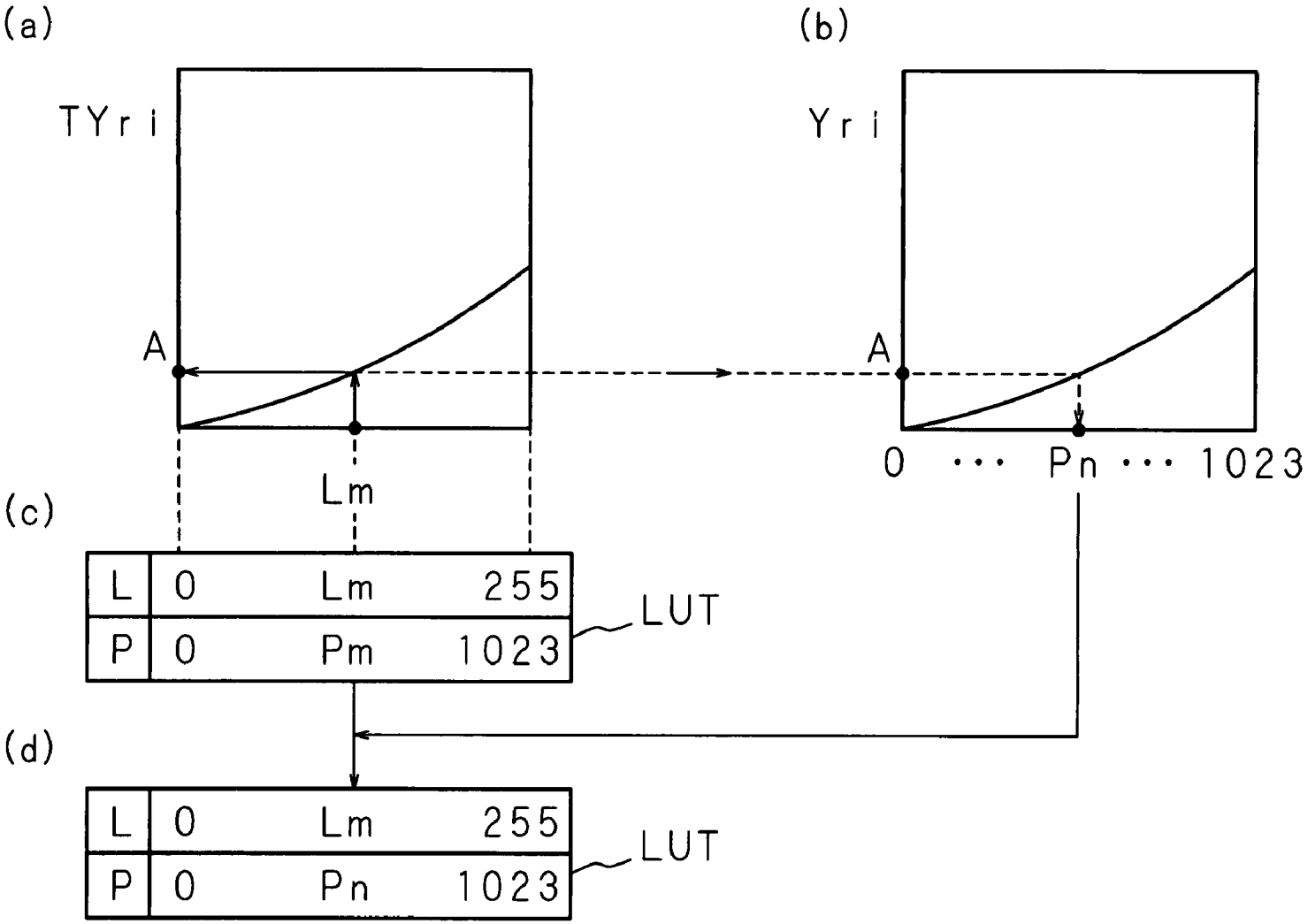
FIG. 6 is a diagram showing a situation that an LUT is calibrated on the basis of a calibration-use display output gradation acquired in Embodiment 1 of the present invention.

Step 7 (S7): For a plurality of gradations of the display input gradation L, a display output gradation P that indicates brightness corresponding to the target single color brightness in the primary display input gradation versus target single color brightness correlation characteristics of each color of RGB is acquired as a calibration-use display output gradation on the basis of the primary display output gradation versus single color brightness correlation characteristics. Then, correspondence between the calibration-use display output gradation and the display input gradation L is established so that the LUT 13 (LUT 13R, LUT 13G, LUT 13B) of each color of RGB is calibrated. This situation is shown in FIG. 6 described later. Here, the number of gradations differs between the display input gradation L and the display output gradation P. Thus, complete one-to-one correspondence is not established between the gradations (integers). Accordingly, when the calibration-use display output gradation is acquired and corresponds to an intermediate point, the gradation is calculated by using interpolation. Further, rounding off is performed appropriately in such a manner that the number of decimal places sufficient for necessary accuracy is ensured. The use of interpolation and rounding off is common to other steps and other embodiments. At this step, the correspondence relation between the maximum gradation L(255,255,255) of the display input gradation L and the (initial-calibration use) display output gradation P(1023,1018,996) and the correspondence relation between the minimum gradation L(0,0,0) of the display input gradation L and the minimum gradation (0,0,0) of the display output gradation P are fixed. Thus, a display output gradation P corresponding to the display input gradation L(254,254,254) through L(1,1,1) included the inside can be acquired.

The LUT 13 is acquired on the assumption that additive color mixing holds when approximation is used. Thus, deviation arises in the brightness and the chromaticity (especially in the brightness). For example, the primary display output gradation versus single color brightness correlation characteristics acquired at Step 4 has been calculated on the assumption that each color is independent. However, actually in the LCD panel 11, mutual relation is present in each color of RGB (e.g., the brightness of R is affected by the brightness of G and B). Thus, the following steps are added further in order to adjust the deviation in the brightness and the chromaticity.

Step 8 (S8): By using the calibrated LUT 13 (LUT 13R, LUT 13G, LUT 13B) for each color of RGB, similarly to Step 3, a calibration white screen is displayed for a plurality of gradations of the display input gradation L, so that the single color brightness of each color of RGB for a plurality of gradations of the display input gradation L is measured in the calibration white screen.

Step 9 (S9): For the single color brightness of each color of RGB, similarly to Step 4, a display output gradation P corresponding to the display input gradation L is applied so that secondary display output gradation versus single color brightness correlation characteristics of each color of RGB is acquired.

Step 10 (S10): For a plurality of gradations of the display input gradation L, similarly to Step 7, a display output gradation P that indicates brightness corresponding to the target single color brightness in the primary display input gradation versus target single color brightness correlation characteristics of each color of RGB is acquired as a calibration-use display output gradation on the basis of the secondary display output gradation versus single color brightness correlation characteristics. Then, correspondence between the calibration-use display output gradation and the display input gradation is established so that the LUT 13 (LUT 13R, LUT 13G, LUT 13B) for each color of RGB is calibrated.

Step 11 (S11): It is determined whether the secondary display output gradation versus single color brightness correlation characteristics has converged. In the case of having converged, the procedure goes to Step 12. The steps between Step 8 and Step 10 are repeated until the characteristics converges.

Step 12 (S12): By using the target γ characteristics as well as the target brightness TYmax at the maximum gradation (L255) of the display input gradation L and the target brightness TYmin at the minimum gradation (L0) which have been set up in advance, secondary target white brightness sTYwi for a plurality of gradations of the display input gradation L is calculated so that secondary display input gradation versus target white brightness correlation characteristics (display input gradation Li: secondary target white brightness sTYwi) is acquired. The formula for sTYwi used at that time is Formula (1) adopted at Step 5. The only difference is in the numerical values substituted into the constants. That is, TYmax is used in place of Yw255, while TYmin is used in place of Yw0.

Step 13 (S13): The secondary target white brightness for a plurality of gradations of the display input gradation L is proportionally distributed by using the ratio s:t:u (Step 6) of the single color brightness, so that target single color brightness of each color of RGB for a plurality of gradations of the display input gradation L is calculated. Thereby, secondary display input gradation versus target single color brightness correlation characteristics of each color of RGB is acquired.

Step 14 (S14): For a plurality of gradations of the display input gradation L, a display output gradation P that indicates brightness corresponding to the target single color brightness in the secondary display input gradation versus target single color brightness correlation characteristics of each color of RGB is acquired as a calibration-use display output gradation on the basis of the converged secondary display output gradation versus single color brightness correlation characteristics. Then, correspondence between the calibration-use display output gradation and the display input gradation is established so that the LUT 13 (LUT 13R, LUT 13G, LUT 13B) for each color of RGB is calibrated. In the secondary target white brightness sTYwi, the target brightness at the maximum gradation (L(255,255,255)) of the display input gradation L and the target brightness at the minimum gradation (L(0,0,0)) are taken into consideration. Thus, at this step, a display output gradation P corresponding to the entire range L(255,255,255) through L(0,0,0) of the display input gradation L can be acquired.

FIG. 4 is a diagram showing primary display output gradation versus single color brightness correlation characteristics acquired in Embodiment 1 of the present invention. Part (a) shows the correlation characteristics between the single color brightness Yri and the display output gradation Pr of R.

Part (b) shows the correlation characteristics between the single color brightness Ygi and the display output gradation Pg of G. Part (c) shows the correlation characteristics between the single color brightness Ybi and the display output gradation Pb of B. These figures show schematic situation of the single color brightness Yri, Ygi, Ybi with respect to the display output gradation P acquired at Step 4.

FIG. 5 is a diagram showing the primary display input gradation versus target white brightness correlation characteristics and the primary display input gradation versus target single color brightness correlation characteristics acquired in Embodiment 1 of the present invention. Part (a) shows the correlation characteristics between the primary display input gradation Li and the target white brightness. This figure shows schematic situation of the primary target white brightness (fTYwi) acquired from Formula (1) of Step 5. Part (b) shows the correlation characteristics between the primary display input gradation Li and the target single color brightness TYri of R. Part (c) shows the correlation characteristics between the primary display input gradation Li and the target single color brightness TYgi of G. Part (d) shows the correlation characteristics between the primary display input gradation Li and the target single color brightness TYbi of B. The target single color brightness TYri, TYgi, and TYbi of each color of RGB is acquired by the proportional distribution of the primary target white brightness (fTYwi) at the single color brightness ratio s:t:u as shown at step S6.

FIG. 6 is a diagram showing a situation that the LUT is calibrated on the basis of the calibration-use display output gradation acquired in Embodiment 1 of the present invention. The situation of R is solely shown. However, the situation is similar to G and B. Part (a) shows the situation of acquiring a target single color brightness TYri=A at a "certain" gradation (Lm) in the primary display input gradation versus target single color brightness correlation characteristics. Part (b) shows a situation that a display output gradation P that indicates brightness corresponding to the target single color brightness TYri=A is acquired as a calibration-use display output Pn on the basis of the primary display output gradation versus single color brightness correlation characteristics. Part (c) shows the LUT before the calibration, where a display output gradation Pm corresponds to a display input gradation Lm. Part (d) shows the LUT after the calibration, where the display output gradation P for the display input gradation Lm has been calibrated into the display output gradation Pn.

Embodiment 2

Figure 7:
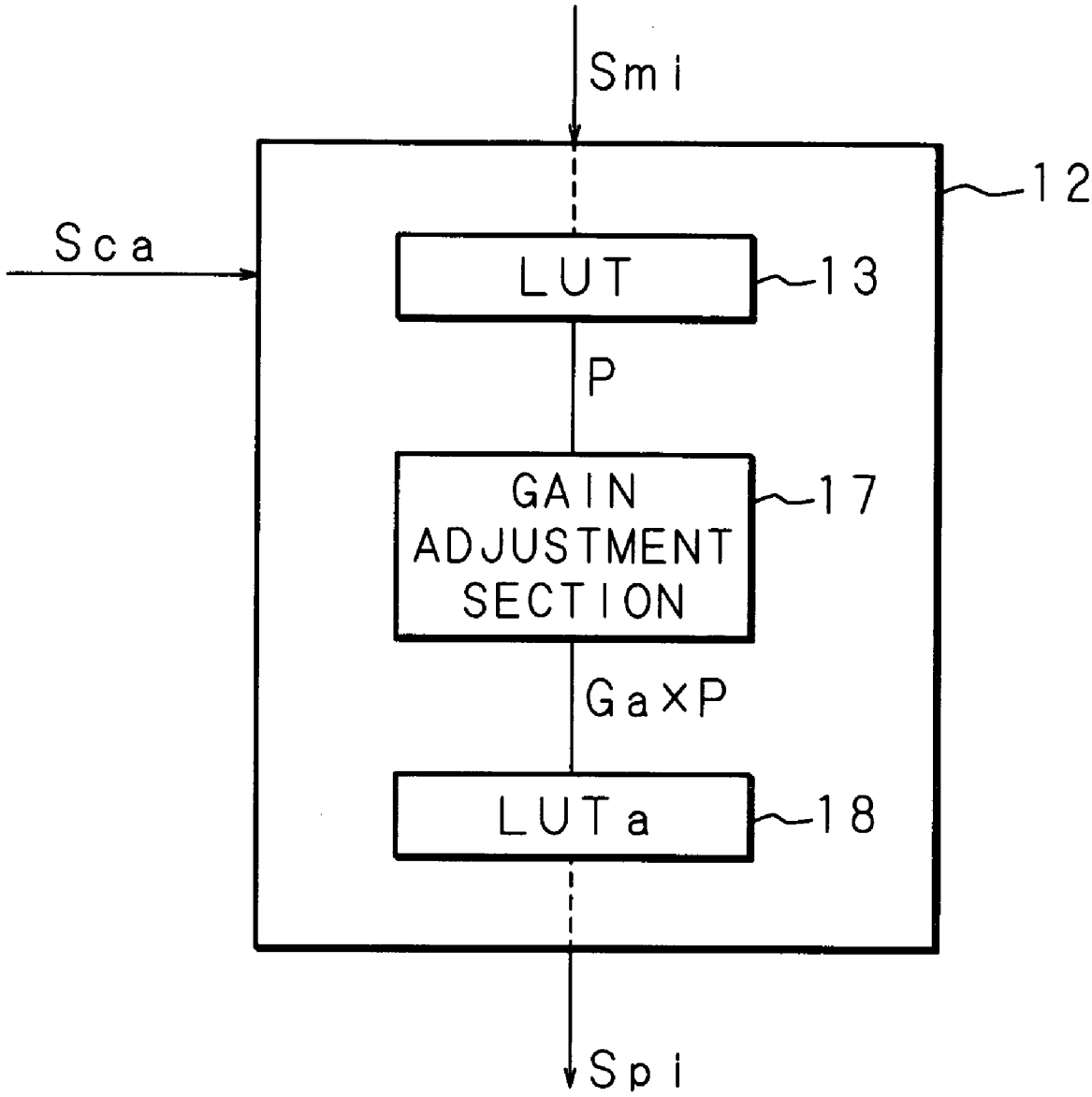
FIG. 7 is a main-part block diagram of implementation of a display characteristics calibration method according to Embodiment 2 of the present invention.

FIG. 7 is a main-part block diagram of implementation of a display characteristics calibration method according to Embodiment 2 of the present invention. The basic configuration employed in the present embodiment is similar to that of FIGS. 1 and 2 of Embodiment 1. However, a major difference is that the configuration of the conversion section 12 is modified. The other part is basically common, and hence detailed description is omitted appropriately. The liquid crystal display monitor 10, the LCD panel 11, the LUT 13, the monitor communication section 14, the light source control section 15, the light source 16, the optical sensor 30, and the PC 20 are similar to those of FIG. 1, and hence not illustrated. The conversion section 12 further comprises an LUT 13, a gain adjustment section 17, and an LUTa 18.

Similarly to the case of FIG. 1, the optical sensor 30 of the present embodiment is attached in a manner opposing the display screen of the LCD panel 11, and hence can measure display light lid emitted from the LCD panel 11. The different point from the optical sensor 30 of FIG. 1 is that when appropriate spectrometry of the display light from a white screen is performed so that the single color brightness of each color of RGB is measured, relative single color brightness (single color brightness in a relative value, that is, single color relative brightness) is measured in place of the single color brightness expressed by an absolute value. That is, measured are the white brightness of the display screen, the brightness of a single color screen of each color of RGB (single color screen brightness), the single color relative brightness, and the white chromaticity.

Similarly to the case of FIG. 1, a monitor input signal Smi is inputted from the PC 20 to the conversion section 12. The monitor input signal Smi is inputted generally as a signal corresponding to the display input gradation L of the LUT 13. By using the LUT 13, the monitor input signal Smi (display input gradation L) is converted into a display output gradation P. The display output gradation P is inputted to the gain adjustment section 17. The display output gradation P is multiplied by a gain constant Ga ($0<Ga\leqq 1$) in the gain adjustment section 17, and then inputted as an adjustment signal ($Ga\times P$) to the additional conversion table (LUTa, hereafter) 18. Then, a panel input signal Spi is inputted to the LCD panel 11 via the LUTa 18. That is, the panel input signal Spi is inputted from the conversion section 12 to the LCD panel 11. As such, in the present embodiment, the display output gradation P is multiplied by a predetermined gain constant Ga so that the panel input signal Spi is adjusted. This enhances the gradation range where the display input gradation L and the display output gradation P in the LUT 13 have correlation relation, and thereby permits more precise gradation control.

The LUTa 18 is used for γ characteristics correction of the LCD panel 11. However, in the present embodiment, the relation between the display input gradation L and the display output gradation P in the LUTa 18 is proportional and fixed. This is substantially equivalent to not being present. Thus, the table is omitted in the following description. Since the adjustment signal is formed by using the gain adjustment section 17, the panel input signal Spi becomes a signal corresponding to the adjustment signal (and the display output gradation P of the LUT 13). Thus, the LCD panel 11 displays brightness corresponding to the adjustment signal (and the display output gradation P of the LUT 13). Further, similarly to the case of FIG. 1, on the basis of the monitor control signal Smc inputted from the PC 20, the monitor communication section 14 outputs a calibration signal Sca to the conversion section 12, thereby rewrites the correspondence relation (correlation relation) between the display input gradation L and the display output gradation P in the LUT 13, and thereby calibrates the LUT 13. Further, the monitor communication section 14 performs gain adjustment for the gain adjustment section 17 by using the calibration signal Sca.

Figure 8:
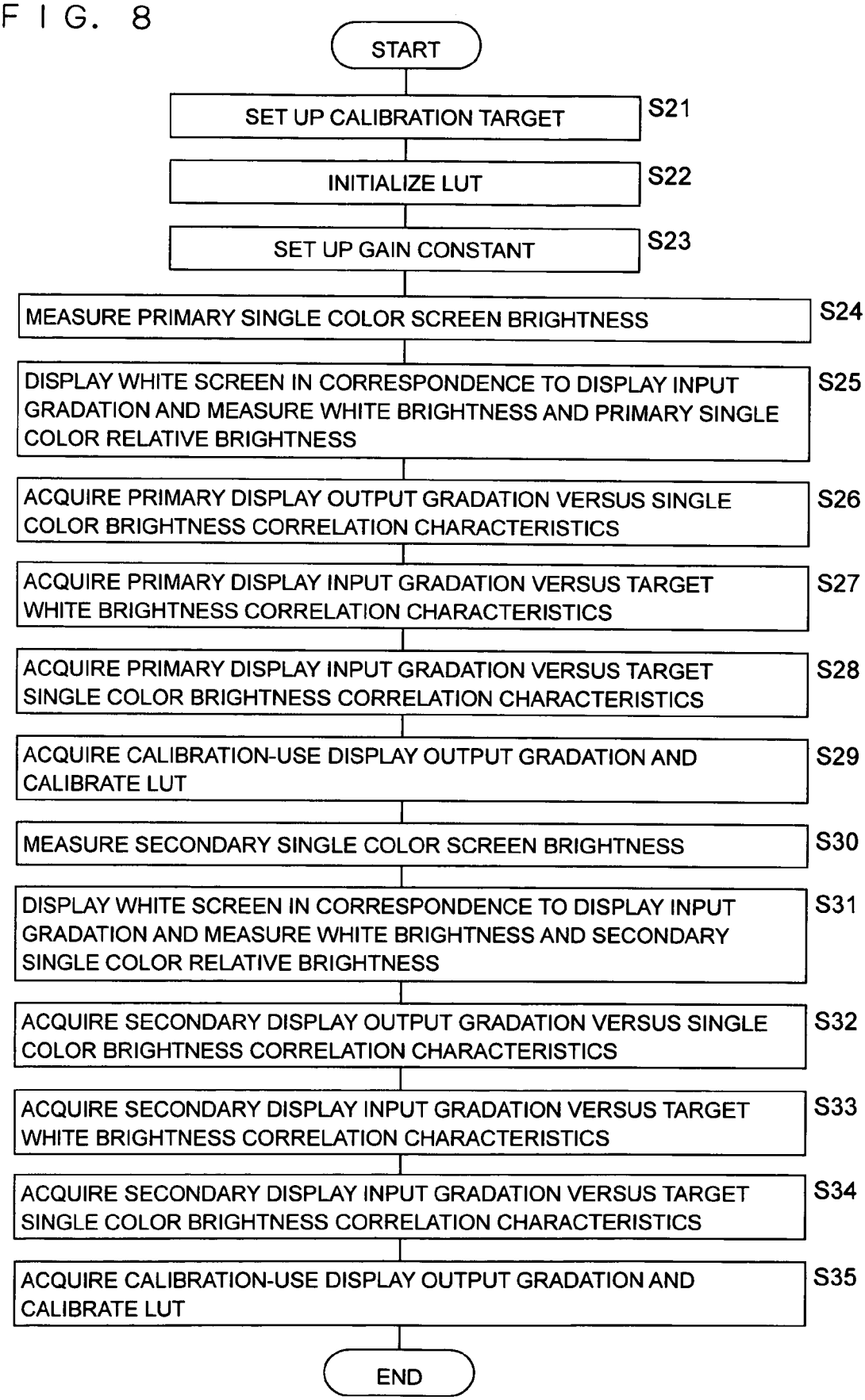
FIG. 8 is a flow chart of executing a display characteristics calibration method according to Embodiment 2 of the present invention.

FIG. 8 is a flow chart of executing a display characteristics calibration method according to Embodiment 2 of the present invention. First, the liquid crystal display monitor 10 and the optical sensor 30 are connected to the PC 20. Then, the conversion table calibration program is started. After that, the following steps are executed similarly to Embodiment 1. Here, in the following steps, the order of steps is not limited to that described below. Further, when necessity, a specific step may be processed simultaneously in parallel to another step.

Step 21 (S21): Similarly to Step 1, a user who is to perform calibration sets up a calibration target. Set up are: the target brightness TYmax (the maximum target brightness) of the case that the display input gradation L is at the maximum gradation L(R,G,B)=(Lr,Lg,Lb)=L(255,255,255); the target brightness TYmin (the minimum target brightness) of the case that the display input gradation L is at the minimum gradation L(R,G,B)=L(0,0,0); the target white chromaticity (tx,ty); and the target γ characteristics.

Step 22 (S22): The LUT 13 (LUT 13R, LUT 13G, LUT 13B) of each color of RGB is initialized. That is, correspondence is established between the maximum gradation L(255, 255,255) of the display input gradation L and the maximum gradation (1023, 1023, 1023) of the display output gradation P of each color, while correspondence is established between the minimum gradation L(0,0,0) and the minimum gradation P(0,0,0), and while in the middle part, correspondence is established with a predetermined function, so that the LUT 13 is calibrated. The predetermined function may be arbitrary as long as the function clearly defines the correlation between the display input gradation L and the display output gradation P. When the function is linear, the calculation becomes easy.

Step 23 (S23): The display input gradation L of each color is set to be the maximum gradation L(255,255,255), and then a white screen is displayed. In a state that this white screen is displayed, each gain constant Ga for each color (a gain constant Gar for R, a gain constant Gag for G, and a gain constant Gab for B) is adjusted, and then the brightness and the white chromaticity of the LCD panel 11 are measured by the optical sensor 30. Then, each gain constant Ga (the gain constant Gar for R, the gain constant Gag for G, and the gain constant Gab for B) is set up that causes the measured brightness and white chromaticity of the LCD panel 11 to become the tentative target brightness (1.2×TYmax) and the target white chromaticity (tx,ty). At that time, calibration is performed preferably not only with adjusting the gain constant Ga but also with adjusting the light source current Iw appropriately. Here, at the time of initial calibration, the tentative target brightness is set greater for example by 20% than the target brightness TYmax (1.20×TYmax). While, the maximum brightness of the LCD panel 11 is basically governed by the light source current Iw. Then, in the LCD panel 11 and the LUT 13 (display input gradation L), adjustment is performed in the direction of reducing the brightness. Thus, in order that a margin of final adjustment should be ensured, the brightness of the white screen is set slightly larger than the target brightness TYmax serving as the final target.

Step 24 (S24): After the setting up of the gain constant Ga of each color of RGB, a single color screen of each color of RGB is displayed. Then, primary single color screen brightness (single color screen brightness (YR,YG,YB) of each color of RGB is measured. Display of the single color screen is performed by setting up the display input gradation L into L(255,0,0) for R display, L(0,255,0) for G display, and L(0, 0,255) for B display.

Step 25 (S25): After the setting up of the gain constant, a white screen is displayed at a plurality of gradations of display input gradation. Then, white brightness (white brightness Ywi when the gradation of the display input gradation L is denoted by i) and primary single color relative brightness (Ysri,Ysgi,Ysbi) of each color of RGB is measured.

Step 26 (S26): With reference to the primary single color screen brightness (YR,YG,YB), each of the primary single color relative brightness (Ysri,Ysgi,Ysbi) of each color of RGB is normalized for the display input gradation L. For example, Ynri(normalized primary single color relative brightness)=YR×Ysri/Ysr255 is acquired for R. The situation is similar to G and B, and hence description is appropriately omitted in the following description. The white brightness Ywi is proportionally distributed by using the ratio of the normalized primary single color relative brightness of a plurality of colors, so that single color brightness (R: Ycri, G: Ycgi, B: Ycbi) for a plurality of gradations of the display input gradation L is calculated. For example, Ycri=Ywi×Ynri/(Ynri+Yngi+Ynbi) is calculated for R. Then, a display output gradation P corresponding to the display input gradation L is applied so that primary display output gradation versus single color brightness correlation characteristics (display output gradation P: single color brightness Ycri,Ycgi,Ycbi) of each color of RGB is acquired. The situation is similar to that of FIG. 4. However, the difference is that the single color brightness at Step 4 is expressed by an actual measurement value, while the single color brightness at the present step is acquired by calculation as described above.

Step 27 (S27): By using the target v value having been set up in advance as well as the tentative target brightness (1.05×TYmax) of the case that the display input gradation L is at the maximum gradation L255 and the tentative target brightness (0.7×TYmin) of the case that the display input gradation is at the minimum gradation L0 which have been set up in advance, primary target white brightness fTYwi for a plurality of gradations of display input gradation is calculated. Thereby, primary display input gradation versus target white brightness correlation characteristics (display input gradation Li: primary target white brightness fTYwi) is acquired. As for the tentative target brightness at the maximum gradation L255, a nearer value (greater by 5% than the target brightness) to the target brightness (TYmax) than the tentative target brightness at Step 23 is adopted so that more accurate adjustment should be performed. As for the tentative target brightness at the minimum gradation L0, adjustment can be performed in the direction of increasing the brightness. Thus, a value, for example, of 0.7 times the target brightness (TYmin) (smaller by 30% than the target brightness) is adopted so that final adjustment can be performed easily and reliably at subsequent steps. The formula for fTYwi used at that time is Formula (1) adopted at Step 5. The only difference is in the numerical values substituted into the constants. That is, in Formula (1), 1.05×TYmax is used in place of Yw255, while 0.7×TYmin is used in place of Yw0.

Step 28 (S28): The ratio of the primary single color screen brightness (YR,YG,YB) of said each color of RGB is acquired as p:q:r=YR/(YR+YG+YB):YG/(YR+YG+YB):YB/(YR+YG+YB). By using the ratio p:q:r (p+q+r=1) of the primary single color screen brightness, the primary target white brightness fTYwi for a plurality of gradations of the display input gradation L is proportionally distributed (p×fTYwi:q×fTYwi:r×fTYwi) so that target single color brightness TYri (=p×fTYwi), TYgi (=q×fTYwi), TYbi (=r×fTYwi) of each color of RGB for a plurality of gradations of display input gradation is calculated. Thereby, primary display input gradation versus target single color brightness correlation characteristics (display input gradation Li: target single color brightness TYri, TYgi, TYbi) of each color of RGB is acquired. The situation is similar to that of FIG. 5. Thus, when target single color brightness for a plurality of gradations of the display input gradation L is acquired by using the ratio of the primary single color screen brightness, white chromaticity at the target single color brightness at the display input gradation L can be maintained at constant (target white chromaticity is maintained).

Step 29 (S29): For a plurality of gradations of the display input gradation L, a display output gradation P that indicates brightness corresponding to the target single color brightness in the primary display input gradation versus target single color brightness correlation characteristics of each color of RGB is acquired as a calibration-use display output gradation on the basis of the primary display output gradation versus single color brightness correlation characteristics. Then, correspondence between the calibration-use display output gradation and the display input gradation L is established so that the LUT 13 (LUT 13R, LUT 13G, LUT 13B) of each color of RGB is calibrated. The situation is similar to that of FIG. 6. Here, in the present embodiment, a target value is set up also for the maximum gradation L(255,255,255) and the minimum gradation L(0,0,0) of the display input gradation L. Thus, a display output gradation P corresponding to the display input gradation L(255,255,255) through L(0,0,0) can be acquired.

The LUT 13 acquired at Step 29 is based on the assumption that additive color mixing holds when approximation is used. Thus, deviation arises in the brightness and the chromaticity (especially in the brightness). For example, the primary display output gradation versus single color brightness correlation characteristics acquired at Step 26 has been calculated on the assumption that each color is independent. However, actually in the LCD panel 11, mutual relation is present in each color of RGB (e.g., the brightness of R is affected by the brightness of G and B). Thus, the following steps are added further in order to adjust the deviation in the brightness and the chromaticity.

Step 30 (S30): A single color screen of each color of RGB is displayed. Then, secondary single color screen brightness of each color of RGB is measured. The terminology of "secondary" single color screen brightness is used in order to indicate that steps similar to the "primary" single color screen brightness are repeated (this situation is common to the other values). The basic processing method is similar to Step 24. The purpose of repeating is to improve accuracy. Thus, detailed description is omitted.

Step 31 (S31): A white screen is displayed at a plurality of gradations of display input gradation. Then, white brightness and secondary single color brightness of each color of RGB are measured. The basic processing method is similar to Step 25. Thus, detailed description is omitted.

Step 32 (S32): With reference to the secondary single color screen brightness, each of the secondary single color brightness of each color of RGB is normalized for the display input gradation. Then, by using the ratio of the normalized secondary single color relative brightness of each color of RGB, the white brightness acquired at Step 31 is proportionally distributed so that single color brightness for a plurality of gradations of display input gradation is calculated. Then, a display output gradation corresponding to the display input gradation is applied so that secondary display output gradation versus single color brightness correlation characteristics of each color of RGB is acquired. The basic processing method is similar to Step 26.

Step 33 (S33): By using the target γ value having been set up in advance as well as the target brightness (TYmax) of the case that the display input gradation is at the maximum gradation L255 and the target brightness (TYmin) of the case that the display input gradation is at the minimum gradation L0 which have been set up in advance, secondary target white brightness for a plurality of gradations of display input gradation is calculated so that secondary display input gradation versus target white brightness correlation characteristics is acquired. The basic processing method is similar to Step 27. Thus, detailed description is omitted.

Step 34 (S34): By using the ratio of the secondary single color screen brightness of each color of RGB, the secondary target white brightness for a plurality of gradations of display input gradation is proportionally distributed so that target single color brightness for a plurality of gradations of display input gradation is calculated. Thereby, secondary display input gradation versus target single color brightness correlation characteristics of each color of RGB is acquired. The basic processing method is similar to Step 28. Thus, detailed description is omitted.

Step 35 (S35): For a plurality of gradations of display input gradation, a display output gradation that indicates brightness corresponding to the target single color brightness in the secondary display input gradation versus target single color brightness correlation characteristics of each color of RGB is acquired as a calibration-use display output gradation on the basis of the secondary display output gradation versus single color brightness correlation characteristics. Then, correspondence between the calibration-use display output gradation and the display input gradation is established so that the LUT 13 (LUT 13R, LUT 13G, LUT 13B) for each color of RGB is calibrated. The basic processing method is similar to Step 29. Thus, detailed description is omitted.

Embodiment 3

Figure 9:
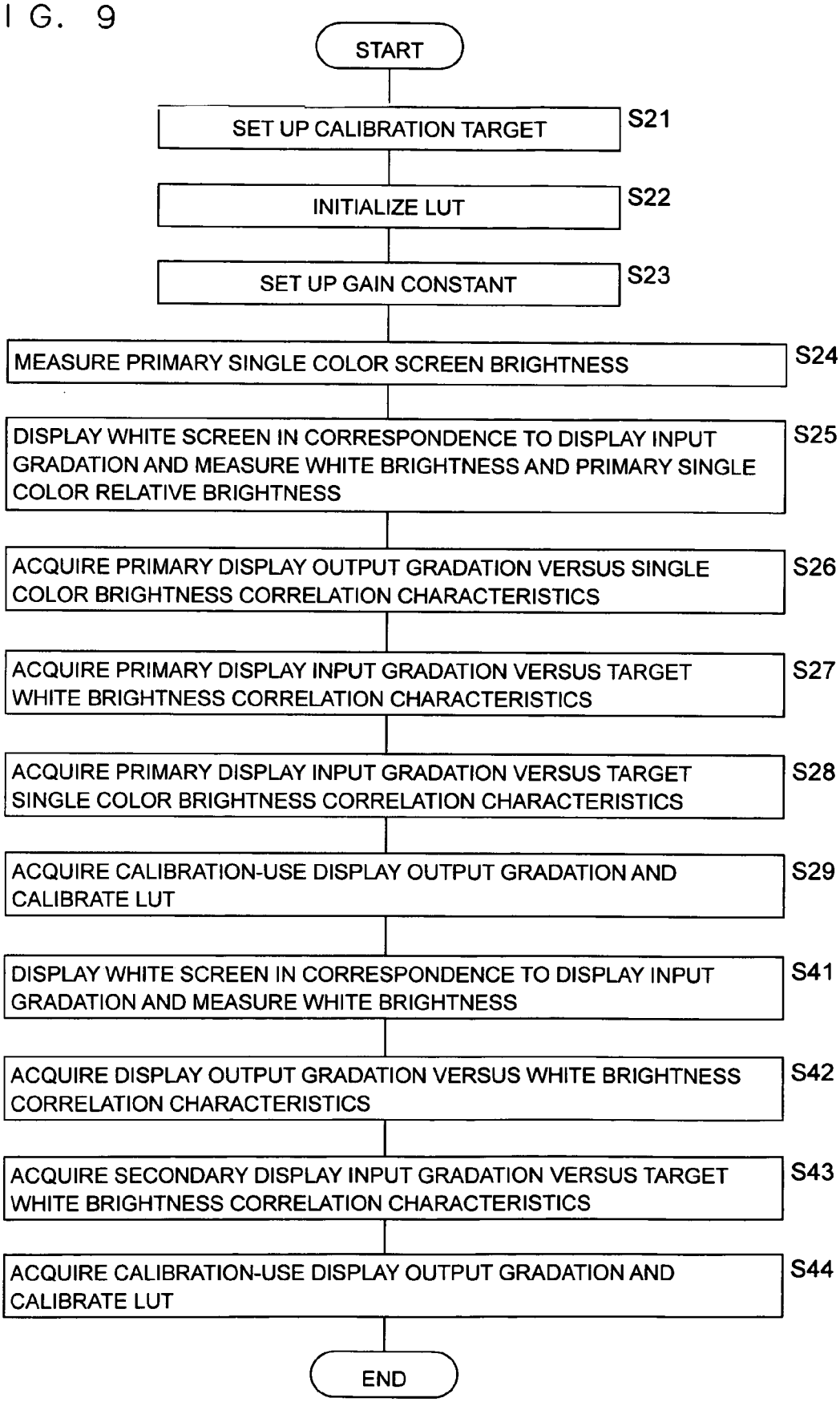
FIG. 9 is a flow chart of executing a display characteristics calibration method according to Embodiment 3 of the present invention.

The basic configuration employed in the present embodiment is similar to that of Embodiment 2. Thus, description is omitted. FIG. 9 is a flow chart of executing a display characteristics calibration method according to Embodiment 2 of the present invention. First, the liquid crystal display monitor 10 and the optical sensor 30 are connected to the PC 20. Then, the conversion table calibration program is started. After that, the following steps are executed similarly to Embodiment 2. Here, in the following steps, the order of steps is not limited to that described below. Further, when necessity, a specific step may be processed simultaneously in parallel to another step. Step 21 (S21) through Step 29 (S29) are similar to those of FIG. 8 of Embodiment 2. Thus, description is omitted.

The situation at the time that Step 29 has been completed is as described above. That is, the LUT 13 acquired at Step 29 is based on the assumption that additive color mixing holds when approximation is used. Thus, deviation arises in the brightness and the chromaticity (especially in the brightness). For example, the primary display output gradation versus single color brightness correlation characteristics acquired at Step 26 has been calculated on the assumption that each color is independent. However, actually in the LCD panel 11, mutual relation is present in each color of RGB (e.g., the brightness of R is affected by the brightness of G and B). Deviation in the chromaticity is smaller than deviation in the brightness. Thus, in the present embodiment, the following steps are further added in order to re-adjust the brightness solely.

Step 41 (S41): A white screen is displayed at a plurality of gradations of the display input gradation L. Then, white brightness Ywi is measured. The basic processing method is similar to a part of Step 25. Thus, detailed description is omitted.

Step 42 (S42): A display output gradation corresponding to the display input gradation L is applied so that display output gradation versus white brightness correlation characteristics (display output gradation P: white brightness Ywi) is acquired. The basic processing method is almost similar to Step 26. However, the difference is that the white brightness Ywi acquired at Step 41 is used in place of the primary single color brightness (Ycri,Ycgi,Ycbi) in the primary display output gradation versus single color brightness correlation characteristics (display output gradation P: single color brightness Ycri,Ycgi,Ycbi). That is, calibration is performed by using the brightness solely.

Step 43 (S43): By using the target γ value having been set up in advance as well as the target brightness (TYmax) of the case that the display input gradation is at the maximum gradation L255 and the target brightness (TYmin) of the case that the display input gradation is at the minimum gradation L0 which have been set up in advance, secondary target white brightness for a plurality of gradations of display input gradation is calculated so that secondary display input gradation versus target white brightness correlation characteristics is acquired. The basic processing method is similar to Step 33. Thus, detailed description is omitted.

Step 44 (S44): For a plurality of gradations of display input gradation, a display output gradation P that indicates brightness corresponding to the secondary target white brightness in the secondary display input gradation versus white brightness correlation characteristics is acquired as a calibration-use display output gradation on the basis of the display output gradation versus white brightness correlation characteristics. Then, correspondence is established between the calibration-use display output gradation and the display input gradation L, so that the conversion table for each color of RGB is calibrated. That is, the LUT 13 (LUT 13R, LUT 13G, LUT 13B) is calibrated. The basic processing method is similar to Step 35. Thus, detailed description is omitted. Here, in the present embodiment, a target value is set up also for the maximum gradation L(255,255,255) and the minimum gradation L(0,0,0) of the display input gradation L. Thus, a display output gradation P corresponding to the display input gradation L(255,255,255) through L(0,0,0) can be acquired.

In Embodiments 2 and 3, the optical sensor 30 may be capable of measuring the brightness and the chromaticity of the screen. In this case, Step 24 (S24) through Step 26 (S26) are modified as described below.

Step 24 (S24): After the setting up of the gain constant Ga of each color of RGB, a single color screen of each color of RGB is displayed. Then, primary single color screen brightness of each color of RGB (single color screen brightness YR,YG,YB) and single color chromaticity (xR,yR),(xG,yG),(xB,yB) are measured. Display of the single color screen is performed by setting up the display input gradation L into L(255,0,0) for R display, L(0,255,0) for G display, and L(0,0,255) for B display.

Step 25 (S25): After the setting up of the gain constant Ga, a white screen is displayed at a plurality of gradations of display input gradation. Then, white brightness (white brightness Ywi when the gradation of the display input gradation L is denoted by i) and white chromaticity (xWi,yWi) are measured. Here, the white chromaticity (xWi,yWi) is equivalent to the white chromaticity (xi,yi). However, representation has been changed in order to indicate the difference of processing step.

Step 26 (S26): By using the primary single color screen brightness (YR,YG,YB), the single color chromaticity (xR,yR),(xG,yG),(xB,yB), the white brightness Ywi at gradation i, and the white chromaticity (xWi,yWi), single color brightness (Ycri,Ycgi,Ycbi) for a plurality of gradations of the display input gradation L of each color of RGB is calculated on the basis of a known arithmetic formula. Then, a display output gradation P corresponding to the display input gradation L is applied so that primary display output gradation versus single color brightness correlation characteristics (display output gradation P: single color brightness Ycri,Ycgi,Ycbi) of each color of RGB is acquired.

The invention claimed is:

1. A display characteristics calibration method for calibrating display characteristics of a color display unit provided with a conversion section having a conversion table for converting a display input gradation into a display output gradation for a plurality of colors and with a color display section for performing display in accordance with the display output gradation outputted from said conversion section, comprising the steps of:

calibrating said conversion section such that said color display section should show predetermined brightness and predetermined white chromaticity at a predetermined gradation of display input gradation;

displaying a white screen in correspondence to the display input gradation;

acquiring single color brightness of the plurality of colors from the displayed white screen, then applying a display output gradation corresponding to the display input gradation, and thereby acquiring correlation of display output gradation versus single color brightness;

calculating target white brightness for a plurality of gradations of display input gradation by using predetermined display characteristics and white brightness at the predetermined gradation;

distributing the target white brightness at a single color brightness ratio of the predetermined gradation and thereby acquiring target single color brightness for a plurality of gradations of display input gradation;

acquiring a display output gradation that indicates brightness corresponding to the target single color brightness for a plurality of gradations of display input gradation, from the correlation of display output gradation versus single color brightness; and establishing correspondence between the acquired display output gradation and the display input gradation and thereby calibrating said conversion table.

2. The display characteristics calibration method according to claim 1, wherein the plurality of colors are red, green, and blue.

3. The display characteristics calibration method according to claim 1, wherein the initial-calibration use display output gradation is adjusted such that the initial-calibration use display output gradation of any one of the plurality of colors should become the maximum gradation of output gradation.

4. The display characteristics calibration method according to claim 1, wherein the plurality of gradations of display input gradation are all gradations of display input gradation.

5. The display characteristics calibration method according to claim 1, wherein said color display unit is a color liquid crystal display unit.

6. A display characteristics calibration method for calibrating display characteristics of a color display unit provided with a conversion section having a conversion table for converting a display input gradation into a display output gradation for a plurality of colors and with a color display section for performing display in accordance with the display output gradation outputted from said conversion section, comprising:

a first step of setting into the maximum gradation the display input gradation of the conversion table for a plurality of colors, then adjusting the display output gradation of the conversion table for a plurality of colors, and thereby acquiring an initial-calibration use display output gradation that causes brightness and white chromaticity of the color display section to become tentative target brightness and target white chromaticity;

a second step of establishing correspondence between the maximum gradation of the display input gradation and the initial-calibration use display output gradation, and thereby performing initial calibration of the conversion table for a plurality of colors such that the correlation between the display input gradation and the display output gradation should become a predetermined function;

a third step of displaying a white screen at a plurality of gradations of display input gradation by using the conversion table for a plurality of colors having undergone the initial calibration;

a fourth step of acquiring single color brightness of a plurality of colors for a plurality of gradations of display input gradation from the white screen, then applying a display output gradation corresponding to the display input gradation, and thereby acquiring primary display output gradation versus single color brightness correlation characteristics of a plurality of colors;

a fifth step of calculating primary target white brightness for a plurality of gradations of display input gradation by using target display characteristics having been set up in advance as well as white brightness of the case that the display input gradation is at the maximum gradation and white brightness of the case that the display input gradation is at the minimum gradation which have been acquired from the white screen, and thereby acquiring primary display input gradation versus target white brightness correlation characteristics;

a sixth step of proportionally distributing the primary target white brightness for a plurality of gradations of display input gradation by using the ratio of the single color brightness of a plurality of colors of the case that the display input gradation is at the maximum gradation, thereby calculating target single color brightness for a plurality of gradations of display input gradation, and thereby acquiring primary display input gradation versus target single color brightness correlation characteristics of a plurality of colors; and a seventh step of acquiring a display output gradation that indicates brightness corresponding to the target single color brightness in the primary display input gradation versus target single color brightness correlation characteristics of a plurality of colors for a plurality of gradations of display input gradation, as a calibration-use display output gradation on the basis of the primary display output gradation versus single color brightness correlation characteristics, then establishing correspondence between the calibration-use display output gradation and the display input gradation, and thereby calibrating the conversion table for a plurality of colors.

7. The display characteristics calibration method according to claim 6, further comprising after said seventh step:

an eighth step of displaying a calibration white screen at a plurality of gradations of display input gradation by using the calibrated conversion table for a plurality of colors;

a ninth step of acquiring single color brightness of a plurality of colors for a plurality of gradations of display input gradation from the calibration white screen, then applying a display output gradation corresponding to the display input gradation, and thereby acquiring secondary display output gradation versus single color brightness correlation characteristics of a plurality of colors; and a tenth step of acquiring a display output gradation that indicates brightness corresponding to the target single color brightness in the primary display input gradation versus target single color brightness correlation characteristics of a plurality of gradations of display input gradation, as a calibration-use display output gradation on the basis of the secondary display output gradation versus single color brightness correlation characteristics, then establishing correspondence between the calibration-use display output gradation and the display input gradation, and thereby calibrating the conversion table for a plurality of colors.

8. The display characteristics calibration method according to claim 7, wherein said eighth step through said tenth step are repeated so that the secondary display output gradation versus single color brightness correlation characteristics should converge.

9. A display characteristics calibration method according to claim 8, further comprising:

an eleventh step of calculating secondary target white brightness for a plurality of gradations of display input gradation by using the target display characteristics as well as target brightness at the maximum gradation of the display input gradation and target brightness at the minimum gradation which have been set up in advance, and thereby acquiring secondary display input gradation versus target white brightness correlation characteristics;

a twelfth step of proportionally distributing the secondary target white brightness for a plurality of gradations of display input gradation by using the ratio of the single color brightness, thereby calculating target single color brightness of a plurality of colors for a plurality of gradations of display input gradation, and thereby acquiring secondary display input gradation versus target single color brightness correlation characteristics of a plurality of colors; and a thirteenth step of acquiring a display output gradation that indicates brightness corresponding to the target single color brightness in the secondary display input gradation versus target single color brightness correlation characteristics of a plurality of colors for a plurality of gradations of display input gradation, as a calibration-use display output gradation on the basis of the converged secondary display output gradation versus single color brightness correlation characteristics, then establishing correspondence between the calibration-use display output gradation and the display input gradation, and thereby calibrating the conversion table for a plurality of colors.

10. The display characteristics calibration method according to claim 9, wherein the tentative target brightness is set greater than the target brightness at the maximum gradation.

11. The display characteristics calibration method according to claim 6, wherein the plurality of colors are red, green, and blue.

12. The display characteristics calibration method according to claim 6, wherein the initial-calibration use display output gradation is adjusted such that the initial-calibration use display output gradation of any one of the plurality of colors should become the maximum gradation of output gradation.

13. The display characteristics calibration method according to claim 6, wherein the plurality of gradations of display input gradation are all gradations of display input gradation.

14. The display characteristics calibration method according to claim 6, wherein said color display unit is a color liquid crystal display unit.

15. A display characteristics calibration apparatus for calibrating display characteristics of a color display unit provided with a conversion section having a conversion table for converting a display input gradation into a display output gradation for a plurality of colors and with a color display section for performing display in accordance with the display output gradation outputted from said conversion section, comprising:

an optical sensor for measuring brightness and white chromaticity of said color display section; and a controller for controlling the processing of calibrating the display characteristics;

wherein said controller is capable of performing the following operations:

a first step of setting into the maximum gradation the display input gradation of the conversion table for a plurality of colors, then adjusting the display output gradation of the conversion table for a plurality of colors, then measuring brightness and white chromaticity of the color display section through said optical sensor, and thereby acquiring an initial-calibration use display output gradation that causes the brightness and the white chromaticity to become target brightness and target white chromaticity;

a second step of establishing correspondence between the maximum gradation of the display input gradation and the initial-calibration use display output gradation, and thereby performing initial calibration of the conversion table for a plurality of colors such that the correlation between the display input gradation and the display output gradation should become a predetermined function;

a third step of displaying a white screen at a plurality of gradations of display input gradation by using the conversion table for a plurality of colors having undergone the initial calibration;

a fourth step of measuring single color brightness of a plurality of colors for a plurality of gradations of display input gradation in the white screen through said optical sensor, then applying a display output gradation corresponding to the display input gradation, and thereby acquiring display output gradation versus single color brightness correlation characteristics of a plurality of colors;

a fifth step of calculating target white brightness for a plurality of gradations of display input gradation by using target display characteristics having been set up in advance as well as white brightness of the case that the display input gradation is at the maximum gradation and white brightness of the case that the display input gradation is at the minimum gradation which have been acquired from the white screen, and thereby acquiring display input gradation versus target white brightness correlation characteristics;

a sixth step of proportionally distributing the target white brightness for a plurality of gradations of display input gradation by using the ratio of the single color brightness of a plurality of colors of the case that the display input gradation is at the maximum gradation, thereby calculating target single color brightness for a plurality of gradations of display input gradation, and thereby acquiring display input gradation versus target single color brightness correlation characteristics of a plurality of colors; and a seventh step of acquiring a display output gradation that indicates brightness corresponding to the target single color brightness in the display input gradation versus target single color brightness correlation characteristics of a plurality of colors for a plurality of gradations of display input gradation, as a calibration-use display output gradation on the basis of the display output gradation versus single color brightness correlation characteristics, then establishing correspondence between the calibration-use display output gradation and the display input gradation, and thereby calibrating the conversion table for a plurality of colors.

16. The display characteristics calibration apparatus according to claim 15, wherein said color display unit is a color liquid crystal display unit provided with a backlight, and wherein at said first step, brightness of the backlight is controlled in parallel.

17. The display characteristics calibration apparatus according to claim 15, wherein the brightness measured by said optical sensor is expressed by an absolute value.

18. The display characteristics calibration apparatus according to claim 15, wherein said optical sensor is capable of measuring brightness and chromaticity, so that single color brightness is calculated from the measured brightness and chromaticity.

19. A recording medium that records a computer program for calibrating display characteristics of a color display unit provided with a conversion section having a conversion table for converting a display input gradation into a display output gradation for a plurality of colors and with a color display section for performing display in accordance with the display output gradation outputted from said conversion section, said computer program comprising the following steps:

a first step of causing the computer to set into the maximum gradation the display input gradation of the conversion table for a plurality of colors, then adjust the display output gradation of the conversion table for a plurality of colors, then acquire brightness and white chromaticity of said color display section, and thereby acquire an initial-calibration use display output gradation that causes the brightness and the white chromaticity to become target brightness and target white chromaticity;

a second step of causing the computer to establish correspondence between the maximum gradation of the display input gradation and the initial-calibration use display output gradation, and thereby perform initial calibration of the conversion table for a plurality of colors such that the correlation between the display input gradation and the display output gradation should become a predetermined function;

a third step of causing the computer to display a white screen at a plurality of gradations of display input gradation by using the conversion table for a plurality of colors having undergone the initial calibration;

a fourth step of causing the computer to acquire single color brightness of a plurality of colors for a plurality of gradations of display input gradation from the white screen, then apply a display output gradation corresponding to the display input gradation, and thereby acquire display output gradation versus single color brightness correlation characteristics of a plurality of colors;

a fifth step of causing the computer to calculate target white brightness for a plurality of gradations of display input gradation by using target display characteristics having been set up in advance as well as white brightness of the case that the display input gradation is at the maximum gradation and white brightness of the case that the display input gradation is at the minimum gradation which have been acquired from the white screen, and thereby acquire display input gradation versus target white brightness correlation characteristics;

a sixth step of causing the computer to proportionally distribute the target white brightness for a plurality of gradations of display input gradation by using the ratio of the single color brightness of a plurality of colors of the case that the display input gradation is at the maximum gradation, thereby calculate target single color brightness for a plurality of gradations of display input gradation, and thereby acquire display input gradation versus target single color brightness correlation characteristics of a plurality of colors; and a seventh step of causing the computer to acquire a display output gradation that indicates brightness corresponding to the target single color brightness in the display input gradation versus target single color brightness correlation characteristics of a plurality of colors for a plurality of gradations of display input gradation, as a calibration-use display output gradation on the basis of the display output gradation versus single color brightness correlation characteristics, then establish correspondence between the calibration-use display output gradation and the display input gradation, and thereby calibrate the conversion table for a plurality of colors.

20. A display characteristics calibration method for calibrating display characteristics of a color display unit provided with: a conversion section having a conversion table for converting a display input gradation into a display output gradation for a plurality of colors; a gain adjustment section for multiplying the display output gradation outputted from said conversion section, by a predetermined gain constant specific to each of a plurality of colors, and then outputting the result as an adjustment gradation; and a color display section for performing display in accordance with the adjustment gradation, comprising the steps of:

establishing correspondence between the correlation of the display input gradation with the display output gradation and a predetermined function and thereby calibrating said conversion table;

setting up the gain constant such that said color display section should display predetermined brightness and predetermined white chromaticity at a predetermined gradation of display input gradation of the calibrated conversion table;

displaying, after setting up the gain constant, a single color screen of each of a plurality of colors and thereby acquiring single color screen brightness of each of a plurality of colors;

displaying, after setting up the gain constant, a white screen at a plurality of gradations of display input gradation and thereby acquiring white brightness and single color brightness of a plurality of colors;

distributing the white brightness at the ratio of the single color brightness of a plurality of colors for the display input gradation with reference to the single color screen brightness, thereby calculating single color brightness for a plurality of gradations of display input gradation, then applying a display output gradation corresponding to the display input gradation, and thereby acquiring correlation of display output gradation versus single color brightness of a plurality of colors;

calculating target white brightness for a plurality of gradations of display input gradation by using predetermined display characteristics and target brightness of the case that the display input gradation is at a predetermined gradation, and thereby acquiring correlation of display input gradation versus target white brightness;

distributing the target white brightness at the display input gradation versus target white brightness at the ratio of the single color screen brightness, and thereby calculating target single color brightness for a plurality of gradations of display input gradation;

acquiring a display output gradation that indicates brightness corresponding to the target single color brightness for a plurality of gradations of display input gradation, from the correlation of display output gradation versus single color brightness; and establishing correspondence between the acquired display output gradation and the display input gradation and thereby calibrating said conversion table.

21. The display characteristics calibration method according to claim 20, wherein the plurality of colors are red, green, and blue.

22. The display characteristics calibration method according to claim 20, wherein the gain constant is such that the gain constant of any one of a plurality of colors is set at the maximum.

23. The display characteristics calibration method according to claim 20, wherein the plurality of gradations of input gradation are all gradations of input gradation.

24. The display characteristics calibration method according to claim 20, wherein said color display unit is a color liquid crystal display unit.

25. A display characteristics calibration method for calibrating display characteristics of a color display unit provided with a conversion section having a conversion table for converting a display input gradation into a display output gradation for a plurality of colors; a gain adjustment section for multiplying the display output gradation outputted from said conversion section, by a predetermined gain constant specific to each of a plurality of colors, and then outputting the result as an adjustment gradation; and a color display section for performing display in accordance with the adjustment gradation, comprising:

a first step of establishing correspondence between the correlation of the display input gradation with the display output gradation and a predetermined function and thereby performing initial calibration of the conversion table for a plurality of colors;

a second step of setting into the maximum gradation the display input gradation of the conversion table for a plurality of colors having undergone the initial calibration, and then setting up the gain constant such that the brightness and the white chromaticity of said color display section should become tentative target brightness and target white chromaticity;

a third step of displaying, after setting up the gain constant, a single color screen of each of a plurality of colors and thereby acquiring primary single color screen brightness of a plurality of colors;

a fourth step of displaying, after setting up the gain constant, a white screen at a plurality of gradations of display input gradation and thereby acquiring white brightness and primary single color brightness of a plurality of colors;

a fifth step of applying a display output gradation corresponding to the display input gradation, to the single color brightness for a plurality of gradations of display input gradation, and thereby acquiring primary display output gradation versus single color brightness correlation characteristics of a plurality of colors;

a sixth step of calculating primary target white brightness for a plurality of gradations of display input gradation by using target display characteristics having been set up in advance as well as tentative target brightness of the case that the display input gradation is at the maximum gradation and tentative target brightness of the case that the display input gradation is at the minimum gradation which have been set up in advance, and thereby acquiring primary display input gradation versus target white brightness correlation characteristics;

a seventh step of proportionally distributing the primary target white brightness for a plurality of gradations of display input gradation by using the ratio of the primary single color screen brightness of a plurality of colors, thereby calculating target single color brightness for a plurality of gradations of display input gradation, and thereby acquiring primary display input gradation versus target single color brightness correlation characteristics of a plurality of colors; and an eighth step of acquiring a display output gradation that indicates brightness corresponding to the target single color brightness in the primary display input gradation versus target single color brightness correlation characteristics of a plurality of colors for a plurality of gradations of display input gradation, as a calibration-use display output gradation on the basis of the primary display output gradation versus single color brightness correlation characteristics, then establishing correspondence between the calibration-use display output gradation and the display input gradation, and thereby calibrating the conversion table for a plurality of colors.

26. The display characteristics calibration method according to claim 25, further comprising after said eighth step:

a ninth step of displaying a single color screen of each of a plurality of colors and thereby acquiring secondary single color screen brightness of a plurality of colors;

a tenth step of displaying a white screen at a plurality of gradations of display input gradation and thereby acquiring white brightness and secondary single color brightness of a plurality of colors;

an eleventh step of applying a display output gradation corresponding to the display input gradation, to the single color brightness for a plurality of gradations of display input gradation, and thereby acquiring secondary display output gradation versus single color brightness correlation characteristics of a plurality of colors;

a twelfth step of calculating secondary target white brightness for a plurality of gradations of display input gradation by using target display characteristics having been set up in advance as well as target brightness of the case that the display input gradation is at the maximum gradation and target brightness of the case that the display input gradation is at the minimum gradation which have been set up in advance, and thereby acquiring secondary display input gradation versus target white brightness correlation characteristics;

a thirteenth step of proportionally distributing the secondary target white brightness for a plurality of gradations of display input gradation by using the ratio of the secondary single color screen brightness of a plurality of colors, thereby calculating target single color brightness for a plurality of gradations of display input gradation, and thereby acquiring secondary display input gradation versus target single color brightness correlation characteristics of a plurality of colors; and a fourteenth step of acquiring a display output gradation that indicates brightness corresponding to the target single color brightness in the secondary display input gradation versus target single color brightness correlation characteristics of a plurality of colors for a plurality of gradations of display input gradation, as a calibration-use display output gradation on the basis of the secondary display output gradation versus single color brightness correlation characteristics, then establishing correspondence between the calibration-use display output gradation and the display input gradation, and thereby calibrating the conversion table for a plurality of colors.

27. A display characteristics calibration method according to claim 26, wherein the tentative target brightness and the target brightness have a relation that the tentative target brightness at said second step> the tentative target brightness at the maximum gradation at said sixth step> the target brightness at the maximum gradation at said twelfth step.

28. The display characteristics calibration method according to claim 25, further comprising after said eighth step:

a fifteenth step of displaying a white screen at a plurality of gradations of display input gradation, thereby acquiring white brightness, then applying a display output gradation corresponding to the display input gradation, and thereby acquiring display output gradation versus white brightness correlation characteristics;

a sixteenth step of calculating secondary target white brightness for a plurality of gradations of display input gradation by using target display characteristics having been set up in advance as well as target brightness of the case that the display input gradation is at the maximum gradation and target brightness of the case that the display input gradation is at the minimum gradation which have been set up in advance, and thereby acquiring secondary display input gradation versus target white brightness correlation characteristics; and a seventeenth step of acquiring a display output gradation that indicates brightness corresponding to the secondary target white brightness in the secondary display input gradation versus white brightness correlation characteristics for a plurality of gradations of display input gradation, as a calibration-use display output gradation on the basis of the display output gradation versus white brightness correlation characteristics, then establishing correspondence between the calibration-use display output gradation and the display input gradation, and thereby calibrating the conversion table for a plurality of colors.

29. A display characteristics calibration method according to claim 28, wherein the tentative target brightness and the target brightness have a relation that the tentative target brightness at said second step> the tentative target brightness at the maximum gradation at said sixth step> the target brightness at the maximum gradation at said sixteenth step.

30. The display characteristics calibration method according to claim 25, wherein the plurality of colors are red, green, and blue.

31. The display characteristics calibration method according to claim 25, wherein the gain constant is such that the gain constant of any one of a plurality of colors is set at the maximum.

32. The display characteristics calibration method according to claim 25, wherein the plurality of gradations of input gradation are all gradations of input gradation.

33. The display characteristics calibration method according to claim 25, wherein said color display unit is a color liquid crystal display unit.

34. A display characteristics calibration apparatus for calibrating display characteristics of a color display unit provided with a conversion section having a conversion table for converting a display input gradation into a display output gradation for a plurality of colors; a gain adjustment section for multiplying the display output gradation outputted from said conversion section, by a predetermined gain constant specific to each of a plurality of colors, and then outputting the result as an adjustment gradation; and a color display section for performing display in accordance with the adjustment gradation, comprising:

an optical sensor for measuring brightness and white chromaticity of said color display section; and a controller for controlling the processing of calibrating the display characteristics;

wherein said controller is capable of performing the following operations:

a first step of establishing correspondence between the correlation of the display input gradation with the display output gradation and a predetermined function and thereby performing initial calibration of the conversion table;

a second step of setting into the maximum gradation the display input gradation of the conversion table of a plurality of colors having undergone the initial calibration, then measuring brightness and white chromaticity of said color display section through said optical sensor, and then setting up the gain constant such that the brightness and said white chromaticity should become target brightness and target white chromaticity;

a third step of displaying, after setting up the gain constant, a single color screen of each of a plurality of colors and then measuring single color screen brightness of a plurality of colors through said optical sensor;

a fourth step of displaying, after setting up the gain constant, a white screen at a plurality of gradations of display input gradation and then measuring white brightness and single color brightness of a plurality of colors through said optical sensor;

a fifth step of applying a display output gradation corresponding to the display input gradation, to the single color brightness for a plurality of gradations of display input gradation, and thereby acquiring display output gradation versus single color brightness correlation characteristics of a plurality of colors;

a sixth step of calculating target white brightness for a plurality of gradations of display input gradation by using target display characteristics having been set up in advance as well as target brightness of the case that the display input gradation is at the maximum gradation and target brightness of the case that the display input gradation is at the minimum gradation which have been set up in advance, and thereby acquiring display input gradation versus target white brightness correlation characteristics;

a seventh step of proportionally distributing the target white brightness for a plurality of gradations of display input gradation by using the ratio of the single color screen brightness of a plurality of colors, thereby calculating target single color brightness for a plurality of gradations of display input gradation, and thereby acquiring display input gradation versus target single color brightness correlation characteristics of a plurality of colors; and an eighth step of acquiring a display output gradation that indicates brightness corresponding to the target single color brightness in the display input gradation versus target single color brightness correlation characteristics of a plurality of colors for a plurality of gradations of display input gradation, as a calibration-use display output gradation on the basis of the display output gradation versus single color brightness correlation characteristics, then establishing correspondence between the calibration-use display output gradation and the display input gradation, and thereby calibrating the conversion table for a plurality of colors.

35. The display characteristics calibration apparatus according to claim 34, wherein said color display unit is a color liquid crystal display unit provided with a backlight, and wherein at said second step, brightness of the backlight is controlled in parallel.

36. The display characteristics calibration apparatus according to claim 34, wherein the single color brightness of a plurality of colors measured by said optical sensor is expressed by a relative value, and wherein the single color brightness is normalized so that the single color brightness at said fifth step is calculated.

37. The display characteristics calibration apparatus according to claim 34, wherein said optical sensor is capable of measuring brightness and chromaticity, so that the single color brightness at said fourth step is calculated from the measured brightness and chromaticity.

38. A recording medium that records a computer program for calibrating display characteristics of a color display unit provided with a conversion section having a conversion table for converting a display input gradation into a display output gradation for a plurality of colors; a gain adjustment section for multiplying the display output gradation outputted from said conversion section, by a predetermined gain constant specific to each of a plurality of colors, and then outputting the result as an adjustment gradation; and a color display section for performing display in accordance with the adjustment gradation, said computer program comprising the following steps:

a first step of causing the computer to establish correspondence between the correlation of the display input gradation with the display output gradation and a predetermined function and thereby perform initial calibration of the conversion table;

a second step of causing the computer to set into the maximum gradation the display input gradation of the conversion table for a plurality of colors having undergone the initial calibration, and then set up the gain constant such that the brightness and the white chromaticity of said color display section should become tentative target brightness and target white chromaticity;

a third step of causing the computer to display, after setting up the gain constant, a single color screen of each of a plurality of colors and thereby acquire primary single color screen brightness of a plurality of colors;

a fourth step of causing the computer to display, after setting up the gain constant, a white screen at a plurality of gradations of display input gradation and thereby acquire white brightness and primary single color brightness of a plurality of colors;

a fifth step of causing the computer to apply a display output gradation corresponding to the display input gradation, to the single color brightness for a plurality of gradations of display input gradation, and thereby acquire primary display output gradation versus single color brightness correlation characteristics of a plurality of colors;

a sixth step of causing the computer to calculate primary target white brightness for a plurality of gradations of display input gradation by using target display characteristics having been set up in advance as well as tentative target brightness of the case that the display input gradation is at the maximum gradation and tentative target brightness of the case that the display input gradation is at the minimum gradation which have been set up in advance, and thereby acquire primary display input gradation versus target white brightness correlation characteristics;

a seventh step of causing the computer to proportionally distribute the primary target white brightness for a plurality of gradations of display input gradation by using the ratio of the primary single color screen brightness of a plurality of colors, thereby calculate target single color brightness for a plurality of gradations of display input gradation, and thereby acquire primary display input gradation versus target single color brightness correlation characteristics of a plurality of colors; and an eighth step of causing the computer to acquire a display output gradation that indicates brightness corresponding to the target single color brightness in the primary display input gradation versus target single color brightness correlation characteristics of a plurality of colors for a plurality of gradations of display input gradation, as a calibration-use display output gradation on the basis of the primary display output gradation versus single color brightness correlation characteristics, then establish correspondence between the calibration-use display output gradation and the display input gradation, and thereby calibrate the conversion table for a plurality of colors.

39. The recording medium according to claim 38, wherein said computer program further comprises, after said eighth step, the following steps:

a ninth step of causing the computer to display a single color screen of each of a plurality of colors and thereby acquire secondary single color screen brightness of a plurality of colors;

a tenth step of causing the computer to display a white screen at a plurality of gradations of display input gradation and thereby acquiring white brightness and secondary single color brightness of a plurality of colors;

an eleventh step of causing the computer to normalize each of the secondary single color brightness of a plurality of colors for the display input gradation with reference to the secondary single color screen brightness, then proportionally distribute the white brightness acquired at said tenth step, by using the ratio of the normalized secondary single color brightness of a plurality of colors, thereby calculate single color brightness for a plurality of gradations of display input gradation, then apply a display output gradation corresponding to the display input gradation, and thereby acquire secondary display output gradation versus single color brightness correlation characteristics of a plurality of colors;

a twelfth step of causing the computer to calculate secondary target white brightness for a plurality of gradations of display input gradation by using target display characteristics having been set up in advance as well as target brightness of the case that the display input gradation is at the maximum gradation and target brightness of the case that the display input gradation is at the minimum gradation which have been set up in advance, and thereby acquire secondary display input gradation versus target white brightness correlation characteristics;

a thirteenth step of causing the computer to proportionally distribute the secondary target white brightness for a plurality of gradations of display input gradation by using the ratio of the secondary single color screen brightness of a plurality of colors, thereby calculate target single color brightness for a plurality of gradations of display input gradation, and thereby acquire secondary display input gradation versus target single color brightness correlation characteristics of a plurality of colors; and a fourteenth step of causing the computer to acquire a display output gradation that indicates brightness corresponding to the target single color brightness in the secondary display input gradation versus target single color brightness correlation characteristics of a plurality of colors for a plurality of gradations of display input gradation, as a calibration-use display output gradation on the basis of the secondary display output gradation versus single color brightness correlation characteristics, then establish correspondence between the calibration-use display output gradation and the display input gradation, and thereby calibrate the conversion table for a plurality of colors.

40. The recording medium according to claim 38, wherein said computer program further comprises, after said eighth step, the following steps:

a fifteenth step of causing the computer to display a white screen at a plurality of gradations of display input gradation, thereby acquire white brightness, then apply a display output gradation corresponding to the display input gradation, and thereby acquire display output gradation versus white brightness correlation characteristics;

a sixteenth step of causing the computer to calculate secondary target white brightness for a plurality of gradations of display input gradation by using target display characteristics having been set up in advance as well as target brightness of the case that the display input gradation is at the maximum gradation and target brightness of the case that the display input gradation is at the minimum gradation which have been set up in advance, and thereby acquire secondary display input gradation versus target white brightness correlation characteristics; and a seventeenth step of causing the computer to acquire a display output gradation that indicates brightness corresponding to the secondary target white brightness in the secondary display input gradation versus white brightness correlation characteristics for a plurality of gradations of display input gradation, as a calibration-use display output gradation on the basis of the display output gradation versus white brightness correlation characteristics, then establish correspondence between the calibration-use display output gradation and the display input gradation, and thereby calibrate the conversion table for a plurality of colors.

* * * * *